US011434678B2

(12) United States Patent
Åberg et al.

(10) Patent No.: US 11,434,678 B2
(45) Date of Patent: Sep. 6, 2022

(54) ADJUSTABLE VEHICLE HINGE

(71) Applicant: Volvo Car Corporation, Gothenburg (SE)

(72) Inventors: Tobias Åberg, Ljungskile (SE); Johan Prim, Sätila (SE)

(73) Assignee: VOLVO CAR CORPORATION, Gothenburg (SE)

( * ) Notice: Subject to any disclaimer, the term of this patent is extended or adjusted under 35 U.S.C. 154(b) by 2 days.

(21) Appl. No.: 17/162,162

(22) Filed: Jan. 29, 2021

(65) Prior Publication Data

US 2022/0243512 A1 Aug. 4, 2022

(51) Int. Cl.
*E05D 7/04* (2006.01)
*E05D 11/08* (2006.01)

(52) U.S. Cl.
CPC ..... *E05D 11/087* (2013.01); *E05Y 2201/21* (2013.01); *E05Y 2900/546* (2013.01)

(58) Field of Classification Search
CPC ..... E05D 7/04; E05D 7/0415; E05D 7/0027; E05D 7/0045; E05D 7/0009; E05D 3/02; E05D 5/02; E05D 5/0207; E05D 5/0215; E05D 5/0223; E05D 5/023; E05D 5/043; E05D 11/0054; E05D 2007/0036; E05D 2007/0469; E05D 2007/0492; E05Y 2600/10; E05Y 2600/502; E05Y 2900/132; E05Y 2900/148; E05Y 2900/532; E05Y 2900/546; E05Y 2600/12; E05Y 2600/31; E05Y 2600/51; E05Y 2600/526; E05Y 2600/54; E05Y 2600/61; E05Y 2600/622;
(Continued)

(56) References Cited

U.S. PATENT DOCUMENTS 5,074,609 A * 12/1991 Dear ..... E05D 7/0423 296/76
7,516,516 B2 4/2009 Wu
(Continued)

FOREIGN PATENT DOCUMENTS

DE 102004057965 A1 * 6/2006 ..... E05D 7/0423
DE 102014215326 B3 * 3/2015 ..... E05D 7/121
(Continued)

*Primary Examiner* — Chuck Y Mah

(74) *Attorney, Agent, or Firm* — Amin, Turocy & Watson, LLP

(57) ABSTRACT

Various vehicle hinge improvements are enabled herein. For instance, a hinge assembly comprises a body-side base plate. The body-side base plate comprises a body-side adjustment block extending perpendicularly away from a flat surface portion of the body-side base plate, a first body-side threaded hole received in the body-side adjustment block, and a second body-side threaded hole received in the body-side adjustment block. A first body-side adjustment bolt is received through a first body-side adjustment channel and threaded into the first body-side threaded hole, wherein rotation of the first body-side adjustment bolt facilitates adjustment of a body-side hinge member in a first direction. A second body-side adjustment bolt is received through the second body-side adjustment channel and threaded into the second body-side threaded hole, wherein rotation of the second body-side adjustment bolt facilitates adjustment of the body-side hinge member in a second direction.

13 Claims, 26 Drawing Sheets

(58) Field of Classification Search
CPC . Y10T 16/554; Y10T 16/534; Y10T 16/5358; Y10T 16/5321; Y10T 16/5322; Y10T 16/53225; Y10T 16/53235; Y10T 16/53247; Y10T 16/53253; E06B 2009/007; B62D 65/06
See application file for complete search history.

(56) References Cited

U.S. PATENT DOCUMENTS

| | | | | |
|---|---|---|---|---|
| 7,653,967 | B2 | 2/2010 | Lowe et al. | |
| 8,739,367 | B2 * | 6/2014 | Park | E05D 7/0423 16/245 |
| 9,810,010 | B1 * | 11/2017 | Woodard | E06B 3/36 |
| 9,822,565 | B2 | 11/2017 | Milder et al. | |
| 10,330,370 | B2 * | 6/2019 | Choi | A47F 3/043 |
| 10,494,112 | B2 * | 12/2019 | Gonzalez Prieto | E05D 7/0415 |
| 10,669,759 | B2 * | 6/2020 | Lu | E05D 7/0054 |
| 10,689,891 | B2 * | 6/2020 | Black | E05D 3/02 |
| 2006/0273619 | A1 * | 12/2006 | Miller | E05D 3/125 296/146.8 |
| 2012/0272479 | A1 * | 11/2012 | Rasel | E05D 5/062 16/382 |
| 2016/0208532 | A1 * | 7/2016 | Humble | E05D 7/0423 |
| 2020/0284077 | A1 | 9/2020 | Borjesson et al. | |
| 2020/0284078 | A1 * | 9/2020 | Prim | E05D 3/02 |
| 2021/0293064 | A1 * | 9/2021 | Gurusamy | E05D 3/02 |

FOREIGN PATENT DOCUMENTS

| | | | | |
|---|---|---|---|---|
| EP | 1094184 | A1 * | 4/2001 | E05D 5/062 |
| FR | 2983510 | A1 * | 6/2013 | E05D 7/0415 |

* cited by examiner

ADJUSTABLE VEHICLE HINGE

TECHNICAL FIELD

The present description generally relates to adjustable vehicle hinges for an automobile tailgate. The present description also relates to methods for making adjustable vehicle hinges.

BACKGROUND

Vehicle tailgates, trunks, or trunk lids are used to close a rear opening of an automobile. Typically, the tailgate is mounted to an automobile body by a hinge assembly or set of hinge assemblies that allow the tailgate to open or close by rotating/pivoting of the hinge in either a manual or powered configuration. Such hinges typically have a portion attached to the automobile body and a portion attached the tailgate.

During assembly and/or operation of the automobile hinge, the hinge and/or tailgate assembly may become misaligned. This can also occur, for instance, during reassembly from collision repair. Such misalignment can lead to unequal panel gaps, poor positioning, and poor weather sealing among other issues. Current hinge designs require complicated and time-consuming adjustment steps, such as loosening of the hinge from the automobile body and/or tailgate, often requiring multiple tools, to adjust/realign the hinge assembly for properly alignment between the tailgate and automobile body. Further, loosening of the hinge can be dangerous in that accidental unfastening can lead to vehicle/tailgate damage or mechanic/operator injury.

Therefore, there exists a need for a hinge assembly that allows for simple, quick, and controlled adjustment of the hinge assembly without requiring many tools.

The above-described background relating to vehicle hinges is merely intended to provide a contextual overview of some current issues and is not intended to be exhaustive. Other contextual information may become further apparent upon review of the following detailed description.

SUMMARY

The following summary is a general overview of various embodiments disclosed herein and is not intended to be exhaustive of limiting upon the disclosed embodiments. Embodiments are better understood upon consideration of the detailed description below in conjunction with the accompanying drawings and claims.

It is an object of the present description to provide for an improved vehicle hinge assembly having improved adjustment features.

In one embodiment, a hinge assembly is described herein. The hinge assembly comprises a body-side base plate, wherein the body-side base plate comprises a body-side adjustment block extending perpendicularly away from a flat surface portion of the body-side base plate, a first body-side threaded hole received in the body-side adjustment block, and a second body-side threaded hole received in the body-side adjustment block, wherein the second body-side threaded hole is in a direction perpendicular to the first body-side threaded hole, a body-side hinge member adjustably received on the body-side base plate, wherein the body-side hinge member comprises a flat surface portion of the body-side hinge member substantially coplanar with the flat surface portion of the body-side base plate, a body-side hinge portion extending perpendicularly away from the flat surface portion of the body-side hinge member, a first body-side adjustment channel received in the body-side hinge portion configured to facilitate adjustment in a first direction, and a second body-side adjustment channel received in the body-side hinge portion configured to facilitate adjustment in a second direction, wherein the second direction is perpendicular to the first direction, a first body-side adjustment bolt received through the first body-side adjustment channel and threaded into the first body-side threaded hole, wherein rotation of the first body-side adjustment bolt facilitates adjustment of the body-side hinge member in the first direction, a first body-side lock ring received on the first body-side adjustment bolt configured to retain a bolt head of the first body-side adjustment bolt against the body-side hinge portion, a second body-side adjustment bolt received through the second body-side adjustment channel and threaded into the second body-side threaded hole, wherein rotation of the second body-side adjustment bolt facilitates adjustment of the body-side hinge member in the second direction, and a second body-side lock ring received on the second body-side adjustment bolt configured to retain a bolt head of the second body-side adjustment bolt against the body-side hinge portion.

In another embodiment, a method for making a hinge assembly is described herein. The method comprises providing a body-side base plate comprising a body-side adjustment block extending perpendicularly away from a flat surface portion of the body-side base plate, drilling and tapping a first body-side threaded hole in the body-side adjustment block, drilling and tapping a second body-side threaded hole in the body-side adjustment block, wherein the second body-side threaded hole is in a direction perpendicular to the first body-side threaded hole, adjustably receiving a body-side hinge member on the body-side base plate, wherein the body-side hinge member comprises a flat surface portion of the body-side hinge member substantially coplanar with the flat surface portion of the body-side base plate and a body-side hinge portion extending perpendicularly away from the flat surface portion of the body-side hinge member, drilling or routing a first body-side adjustment channel in the body-side hinge portion configured to facilitate adjustment in a first direction, drilling or routing a second body-side adjustment channel in the body-side hinge portion configured to facilitate adjustment in a second direction, wherein the second direction is perpendicular to the first direction, providing a first body-side adjustment bolt through the first body-side adjustment channel and threading the first body-side adjustment bolt into the first body-side threaded hole, wherein rotation of the first body-side adjustment bolt facilitates adjustment of the body-side hinge member in the first direction, providing a first body-side lock ring on the first body-side adjustment bolt configured to retain a bolt head of the first body-side adjustment bolt against the body-side hinge portion, providing a second body-side adjustment bolt through the second body-side adjustment channel and threading the second body-side adjustment bolt into the second body-side threaded hole, wherein rotation of the second body-side adjustment bolt facilitates adjustment of the body-side hinge member in the second direction, and providing a second body-side lock ring on the second body-side adjustment bolt configured to retain a bolt head of the second body-side adjustment bolt against the body-side hinge portion.

In a further embodiment, a vehicle tailgate hinge assembly is described herein. The vehicle tailgate hinge assembly comprises a body-side base plate adapted to be mounted to an automobile body with a pair of body-mounting studs extending perpendicularly away from a bottom surface of the body-side base plate, wherein the body-side base plate comprises a body-side adjustment block extending perpendicularly away from a top surface of the body-side base plate, a first body-side threaded hole received in the body-side adjustment block, and a second body-side threaded hole received in the body-side adjustment block, wherein the second body-side threaded hole is in a direction perpendicular to the first body-side threaded hole, a body-side hinge member adjustably received on the body-side base plate, wherein the body-side hinge member comprises a bottom surface of the body-side hinge member substantially coplanar with the top surface of the body-side base plate, a body-side hinge portion extending perpendicularly away from the top surface of the body-side hinge member, a first body-side adjustment channel received in the body-side hinge portion configured to facilitate adjustment in a first direction, and a second body-side adjustment channel received in the body-side hinge portion configured to facilitate adjustment in a second direction, wherein the second direction is perpendicular to the first direction, a first body-side adjustment bolt received through the first body-side adjustment channel and threaded into the first body-side threaded hole, wherein rotation of the first body-side adjustment bolt facilitates adjustment of the body-side hinge member in the first direction, a first body-side lock ring received on the first body-side adjustment bolt configured to retain a bolt head of the first body-side adjustment bolt against the body-side hinge portion, a second body-side adjustment bolt received through the second body-side adjustment channel and threaded into the second body-side threaded hole, wherein rotation of the second body-side adjustment bolt facilitates adjustment of the body-side hinge member in the second direction, a second body-side lock ring received on the second body-side adjustment bolt configured to retain a bolt head of the second body-side adjustment bolt against the body-side hinge portion, a pair of body-side coaxial holes at a distal end of the body-side hinge member configured to receive a shaft, a tailgate-side base plate, wherein the tailgate-side base plate comprises a tailgate-side adjustment block extending perpendicularly away from a flat surface portion of the tailgate-side base plate, a tailgate-side threaded hole received in the tailgate-side adjustment block, and a tailgate-side locking stud extending perpendicularly away from the flat surface portion of the tailgate-side base plate, and a tailgate-side hinge member adjustably received on the tailgate-side base plate, wherein the tailgate-side hinge member comprises a flat surface portion of the tailgate-side hinge member substantially coplanar with the flat surface portion of the tailgate-side base plate, a tailgate-side hinge portion extending outward from the flat surface portion of the tailgate-side hinge member, and a tailgate-side adjustment channel received in the tailgate-side hinge portion configured to facilitate adjustment in a third direction, a tailgate-side adjustment bolt received through the tailgate-side adjustment hole and threaded into the tailgate-side adjustment hole, wherein rotation of the tailgate-side adjustment bolt facilitates adjustment of the tailgate-side hinge member in the third direction, and a tailgate-side lock ring received on the tailgate-side adjustment bolt configured to retain a bolt head of the tailgate-side adjustment bolt against the tailgate-side hinge portion, wherein the tailgate-side hinge member is rotatably attached to the body-side hinge member with a shaft that passes through a pair body-side hinge member coaxial holes of the body-side hinge member and a pair of tailgate-side hinge member coaxial holes of the tailgate-side hinge member.

DESCRIPTION OF DRAWINGS

Various non-limiting embodiments of the subject disclosure are described with reference to the following figures, wherein like reference numerals refer to like parts throughout unless otherwise specified.

DETAILED DESCRIPTION

Figure 1:
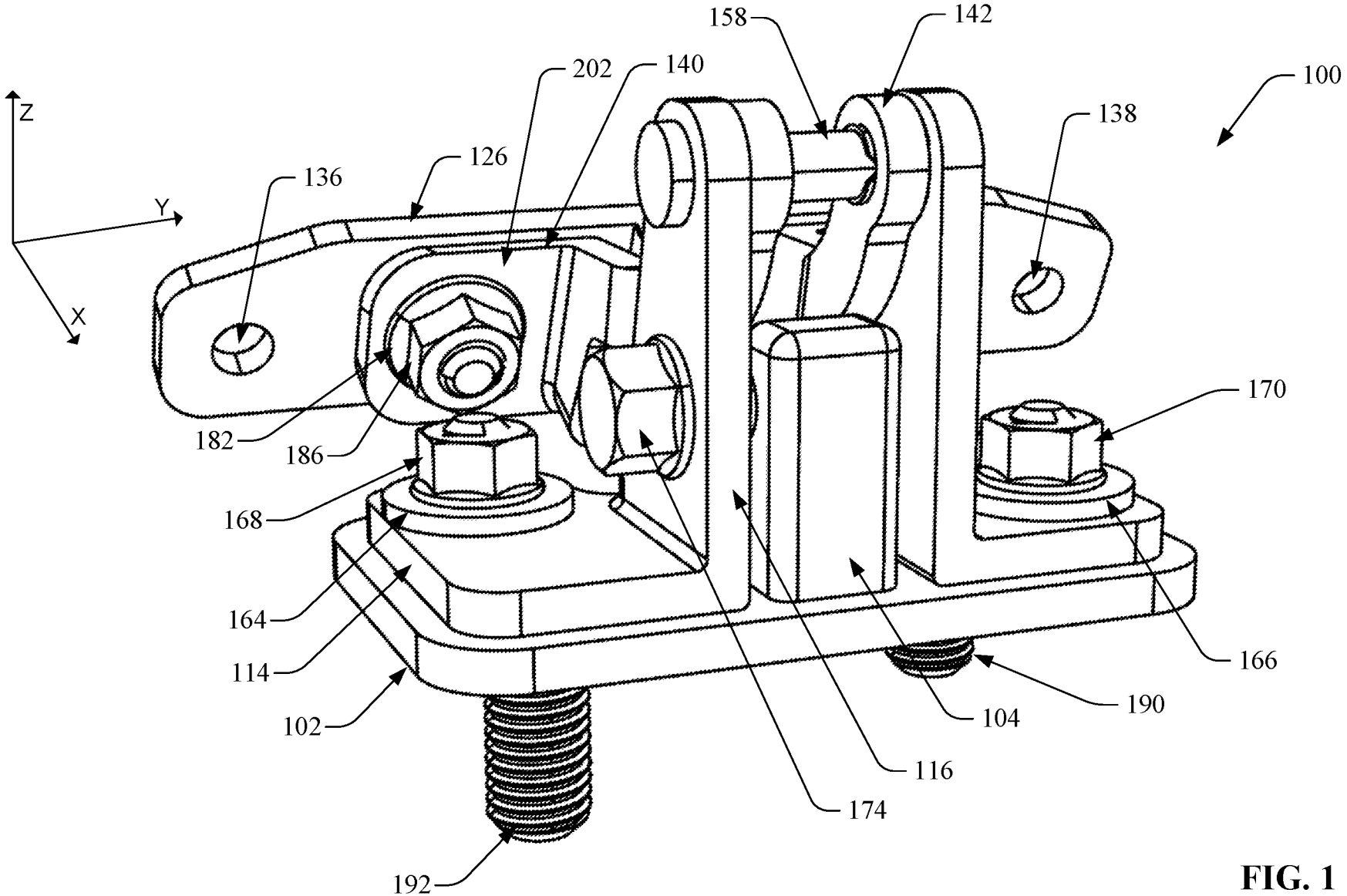
FIG. 1 shows an exemplary hinge assembly in accordance with one or more embodiments described herein.
Figure 2:
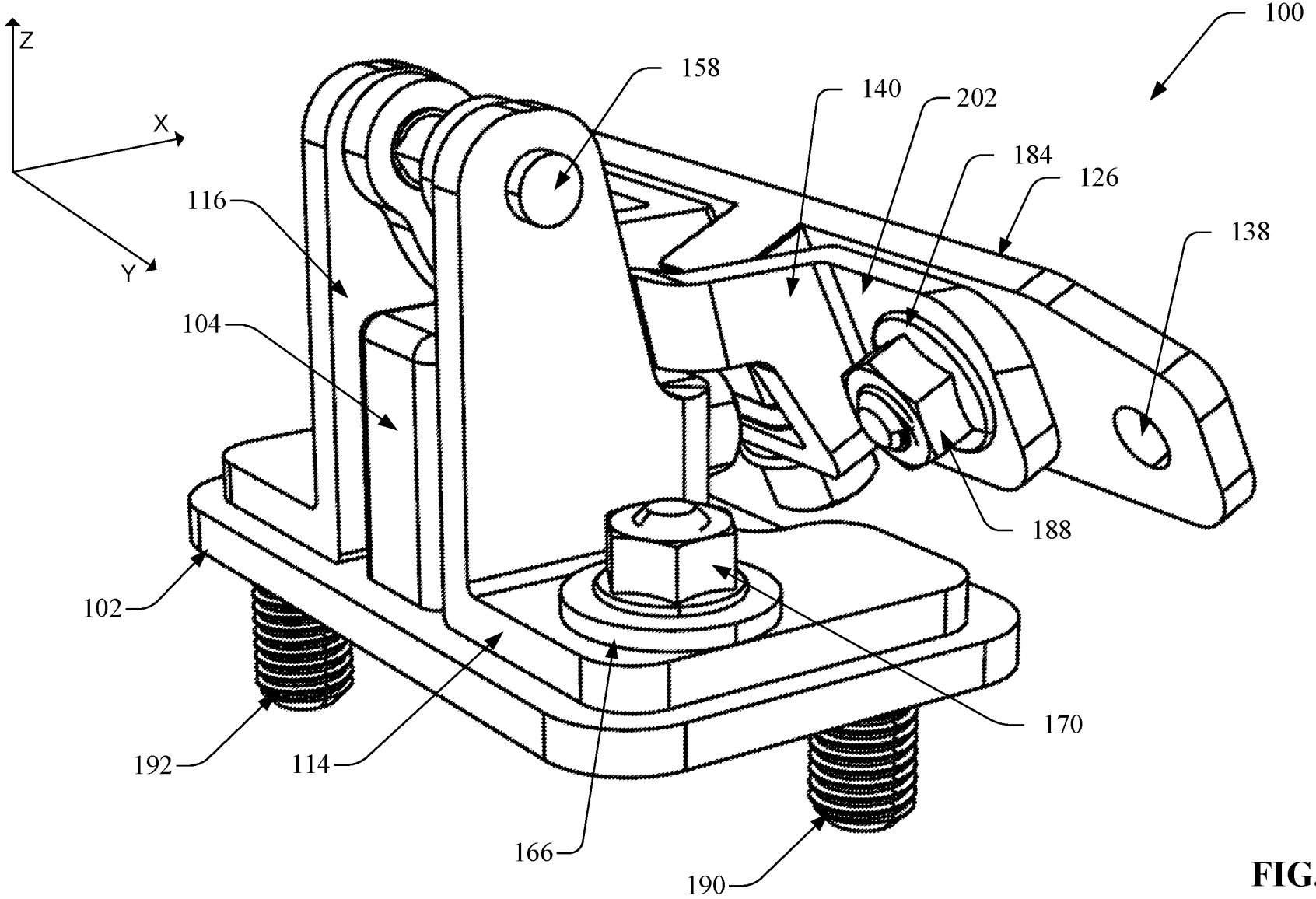
FIG. 2 shows an exemplary hinge assembly in accordance with one or more embodiments described herein.
Figure 3:
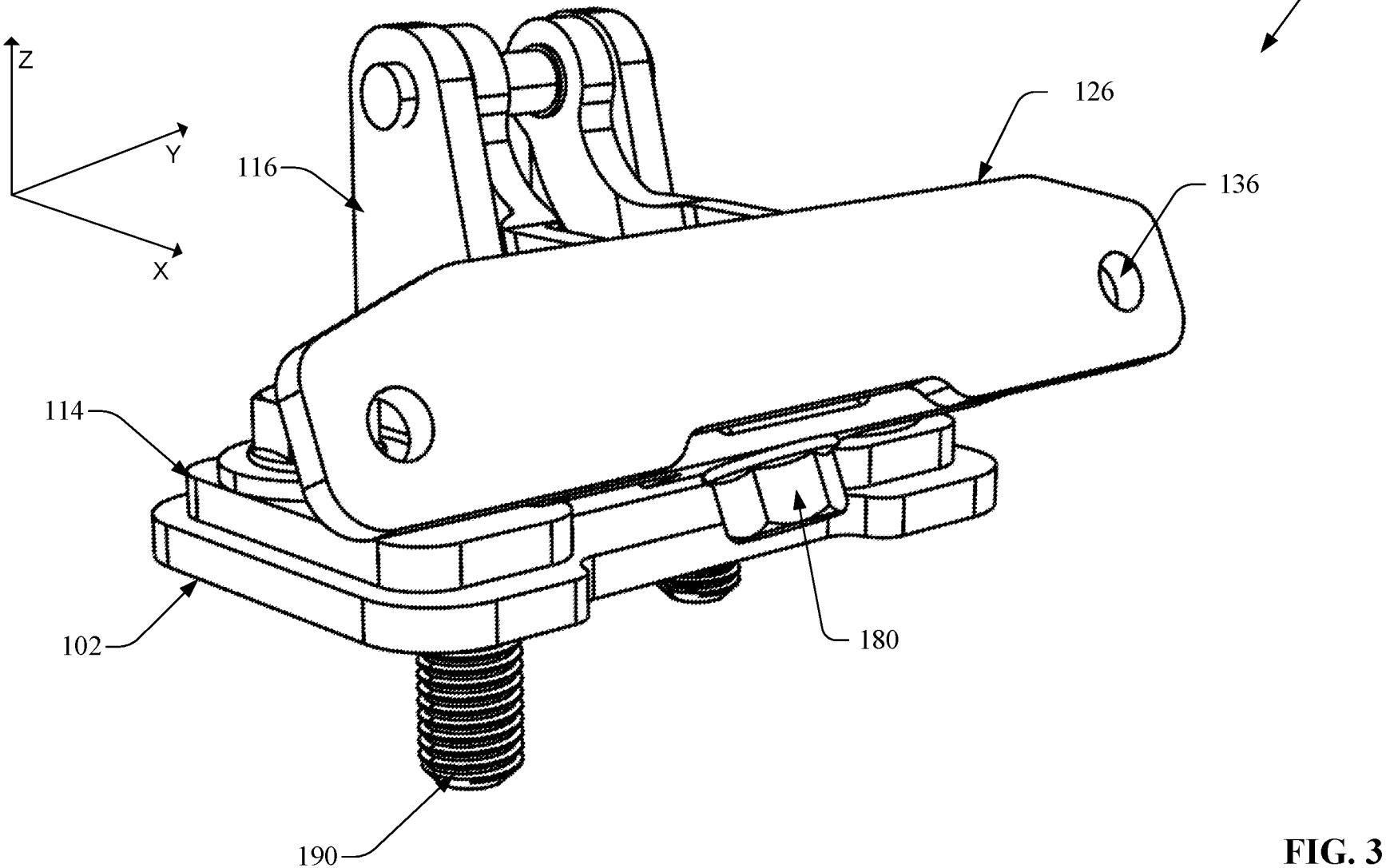
FIG. 3 shows an exemplary hinge assembly in accordance with one or more embodiments described herein.
Figure 4:
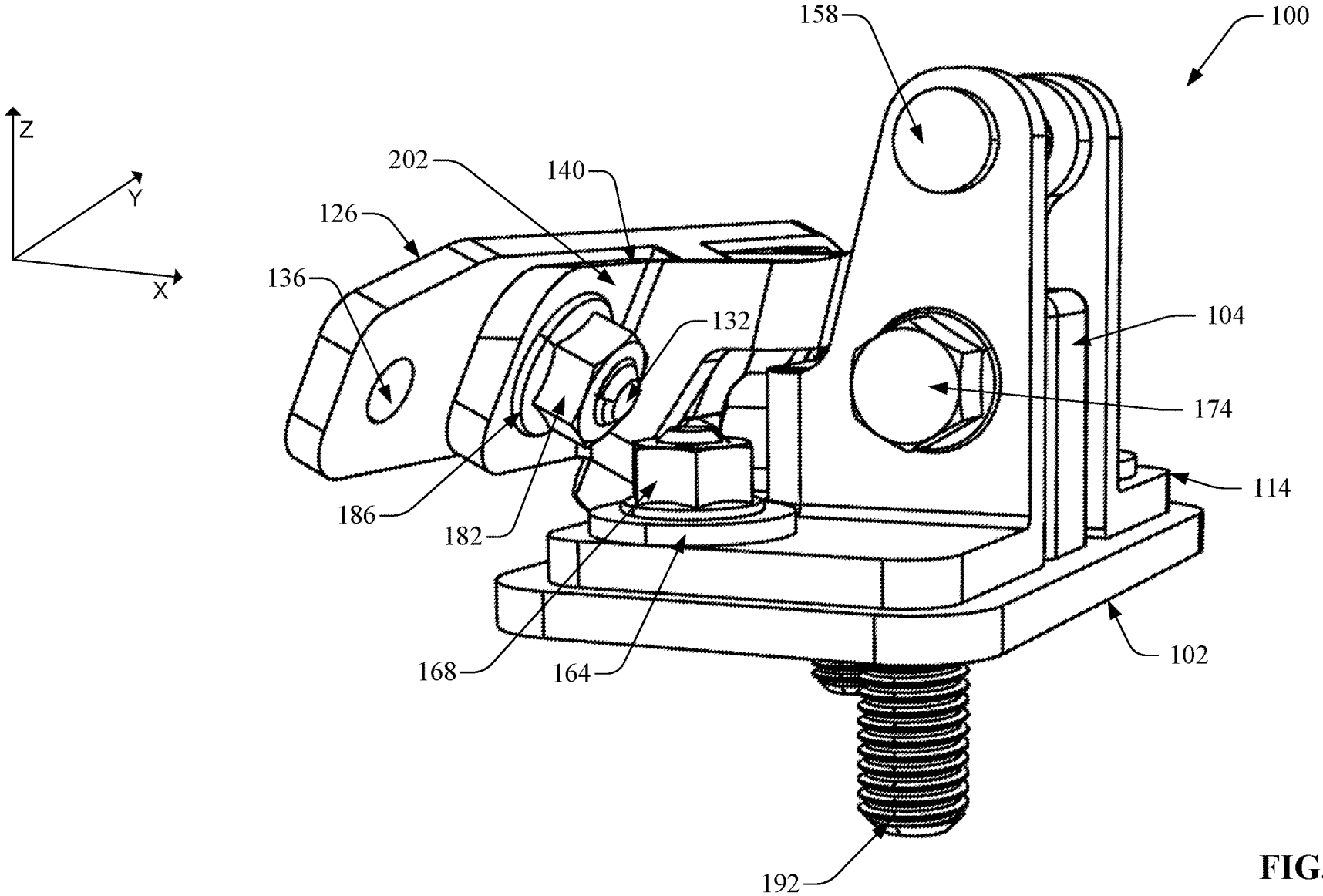
FIG. 4 shows an exemplary hinge assembly in accordance with one or more embodiments described herein.

Various specific details of the disclosed embodiments are provided in the description below. One skilled in the art will recognize, however, that the techniques described herein can in some cases be practiced without one or more of the specific details, or with other methods, components, materials, etc. In other instances, well-known structures, materials, or operations are not shown or described in detail to avoid obscuring certain aspects.

For purposes of the following description, certain terminology is used for convenience only and is not limiting. The characterizations of various components and orientations described herein as being "front," "back," "vertical," "horizontal," "upright," "right," "left," "side," "top," "bottom," "above," "below," or the like designate directions in the drawings to which reference is made and are relative characterizations only based upon the particular position or orientation of a given component, as illustrated. These terms shall not be regarded as limiting the invention. The words "downward" and "upward" refer to position in a vertical direction relative to a geometric center of the apparatus of the present invention and designated parts thereof. The terminology includes the words above specifically mentioned, derivatives thereof, and words of similar import.

With reference to FIGS. 1-4, there are illustrated different views of a hinge assembly 100 in accordance with various embodiments herein. FIGS. 2-25 illustrate various component(s) or subcomponent(s) of said hinge assembly 100. In this regard, the hinge assembly 100 is illustrated in various states of construction/deconstruction in order to illustrate its plurality of components and subcomponents. Therefore, it should be appreciated that some components or subcomponents may not be visible in some drawings, but this does not preclude inclusion of such omitted components or subcomponents since such an omission may only be for visualization purposes.

The hinge assembly 100 is configured to be easily adjustable after the mounting of a tailgate to an automobile body using the hinge assembly 100. In certain embodiments, at least two hinge assemblies 100 are used to attach a vehicle tailgate to a vehicle body. The hinge assembly 100 can be engineered and used for attaching any tailgate to any automobile. The tailgate may typically be used on a station wagon, a sport utility vehicle (SUV) or crossover, a truck, a sedan, a couple, a convertible, a hatchback, or a van/minivan, for example. The tailgate can be opened by (manually or automatically) lifting a top, a bottom, or a side of the tailgate away from the vehicle body, depending on the type of vehicle.

The hinge assembly 100 can comprise a body-side base plate 102. The body-side base plate 102 can be configured to be mounted to a vehicle body in a substantially flush manner using, for instance, adhesive, welding, and/or fasteners (e.g., screws, nuts/bolts, rivets, etc.). That said, one skilled in the art would understand that it is possible to instead install the body-side base plate on a vehicle tailgate. The body-side base plate 102 can comprise a body-side mounting stud 190 and/or a body-side mounting stud 192. The body-side mounting studs (body-side mounting stud 190 and body-side mounting stud 192, collectively) can be welded to a bottom side of a surface of a body-side base plate flat portion 196 the body-side base plate 102. In other embodiments, the body-side mounting studs can be milled or otherwise machined. It can be appreciated that each of the body-side mounting studs can be threaded to receive a fastener (e.g., a nut). The body-side base plate 102 can comprise a body-side locking stud 110 and/or a body-side locking stud 112. The body-side locking studs (body-side locking stud 110 and body-side locking stud 112, collectively) can be located on a top side of a surface of a body-side base plate flat portion 196 of the body-side base plate 102 and can extend perpendicularly away from the body-side base plate 102. The body-side locking studs can be welded to a top side of the body-side base plate 102. In other embodiments, the body-side locking studs can be milled or otherwise machined. The body-side base plate 102 can additionally comprise a body-side adjustment block 104 which will be later discussed in greater detail. It can be appreciated that the body-side adjustment block 104 can extend perpendicularly away from a surface of a body-side base plate flat portion 196 of the body-side base plate 102.

The hinge assembly 100 can further comprise a body-side hinge member 114. The body-side hinge member 114 can comprise a body-side hinge member flat portion 198 of which a surface can be substantially coplanar with a surface of the body-side base plate flat portion 196 of the body-side base plate 102. The body-side hinge member 114 can be adjustably received in a y-direction (e.g., a first direction) and an x-direction (e.g., a second direction) atop the body-side base plate 102. In this regard, a bottom side of the body-side hinge member 114 can be flat and can be substantially coplanar with a top side of the body-side base plate 102. Body-side locking nut 170 can be configured to thread onto the body-side locking stud 110. In this regard, the body-side locking nut 170 and body-side locking stud 110 can comprise corresponding thread patterns. Similarly, body-side locking nut 168 can be configured to thread onto the body-side locking stud 112. In this regard, the body-side locking nut 168 and body-side locking stud 112 can comprise corresponding thread patterns. Body-side washer 166 can be received between the body-side hinge member 114 and the body-side locking nut 170. Likewise, body-side washer 164 can be received between the body-side hinge member 114 and the body-side locking nut 168. In other embodiments, body-side washer 166 and body-side locking nut 170 can be integrated, wherein the body-side locking nut 170 comprises a flange nut with a washer-like flange disposed at one end of the body-side locking nut 170. Likewise, body-side washer 164 and body-side locking nut 168 can be integrated, wherein the body-side locking nut 168 comprises a flange nut with a washer-like flange disposed at one end of the body-side locking nut 168. It can be appreciated that tightening of the body-side locking nuts (body-side locking nut 168 and body-side locking nut 170, collectively) can prevent movement of the body-side hinge member 114 relative to the body-side base plate 102. Similarly, loosening of the body-side locking nuts can allow for the body-side hinge member 114 to be adjusted in an x-direction and/or a y-direction relative to the body-side base plate 102. Oil or grease can be provided between the body-side hinge member 114 and body-side base plate 102 to ease adjustment. Adjustment of the body-side hinge member 114 relative to the body-side base plate 102 is later discussed in greater detail.

The hinge assembly 100 can additionally comprise a tailgate-side base plate 126. The tailgate-side base plate 126 can be configured to be attached to a tailgate (e.g., using tailgate mounting hole 136 and/or tailgate mounting hole 138) in a substantially flush manner using, for instance, adhesive, welding, and/or fasteners (e.g., screws, nuts/bolts, rivets, etc.). That said, one skilled in the art would understand that it is possible to reverse the hinge assembly 100 so that the tailgate-side base plate 126 is installed on a vehicle body. The tailgate-side base plate 126 can be configured to be attached to the tailgate-side hinge member 140. The tailgate-side hinge member 140 can comprise a tailgate-side hinge portion 142 which can be configured to be hingedly attached to a body-side hinge portion 116 of the body-side hinge member 114 via a shaft 158 (later discussed in greater detail) or a different component for rotatably coupling the tailgate-side hinge member 140 to the body-side hinge member 114. The tailgate-side hinge portion 142 can extend outward from a surface of a tailgate-side hinge member flat portion 202 of the tailgate-side hinge member 140.

Figure 5:
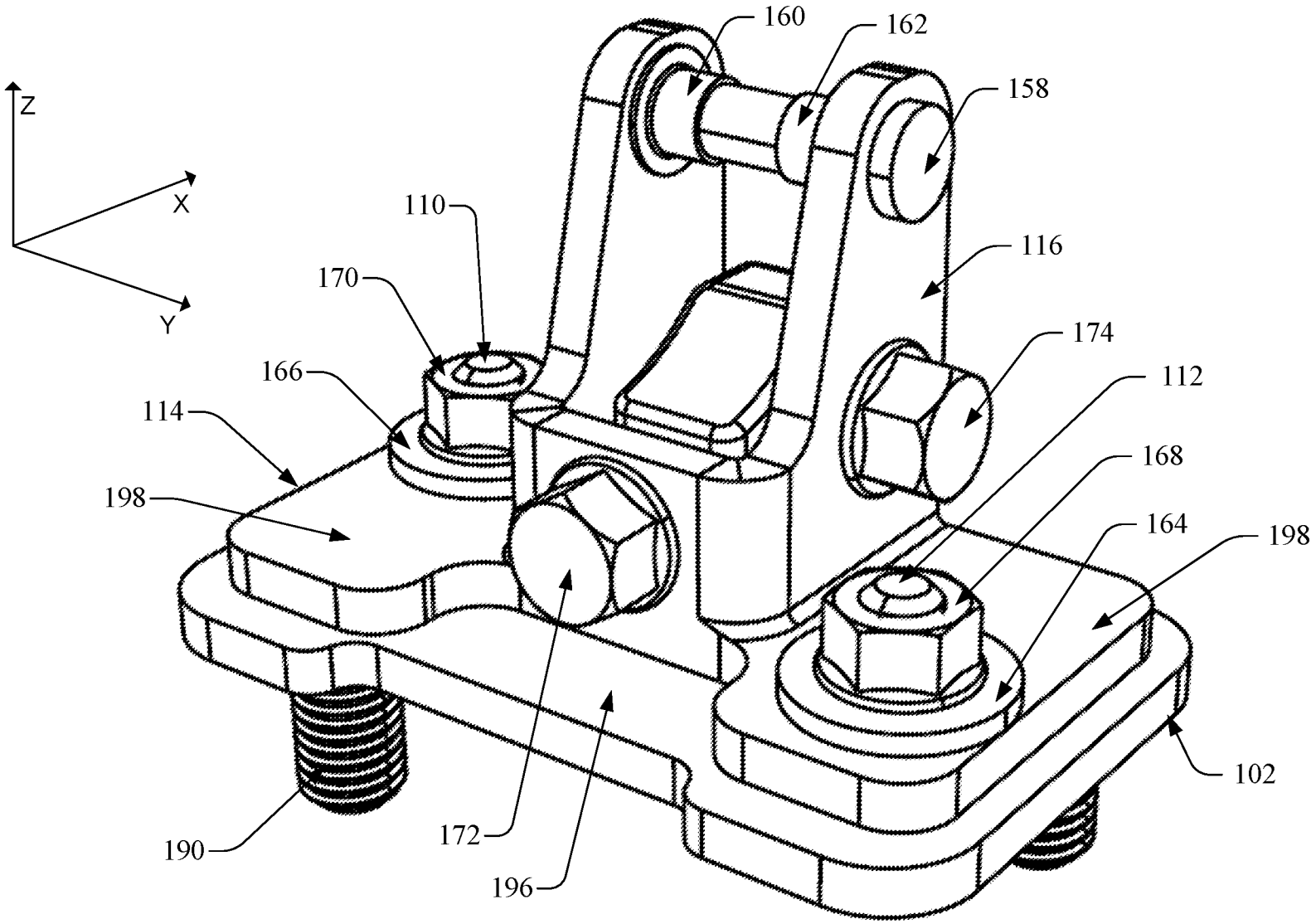
FIG. 5 shows exemplary hinge assembly component(s) in accordance with one or more embodiments described herein.
Figure 6:
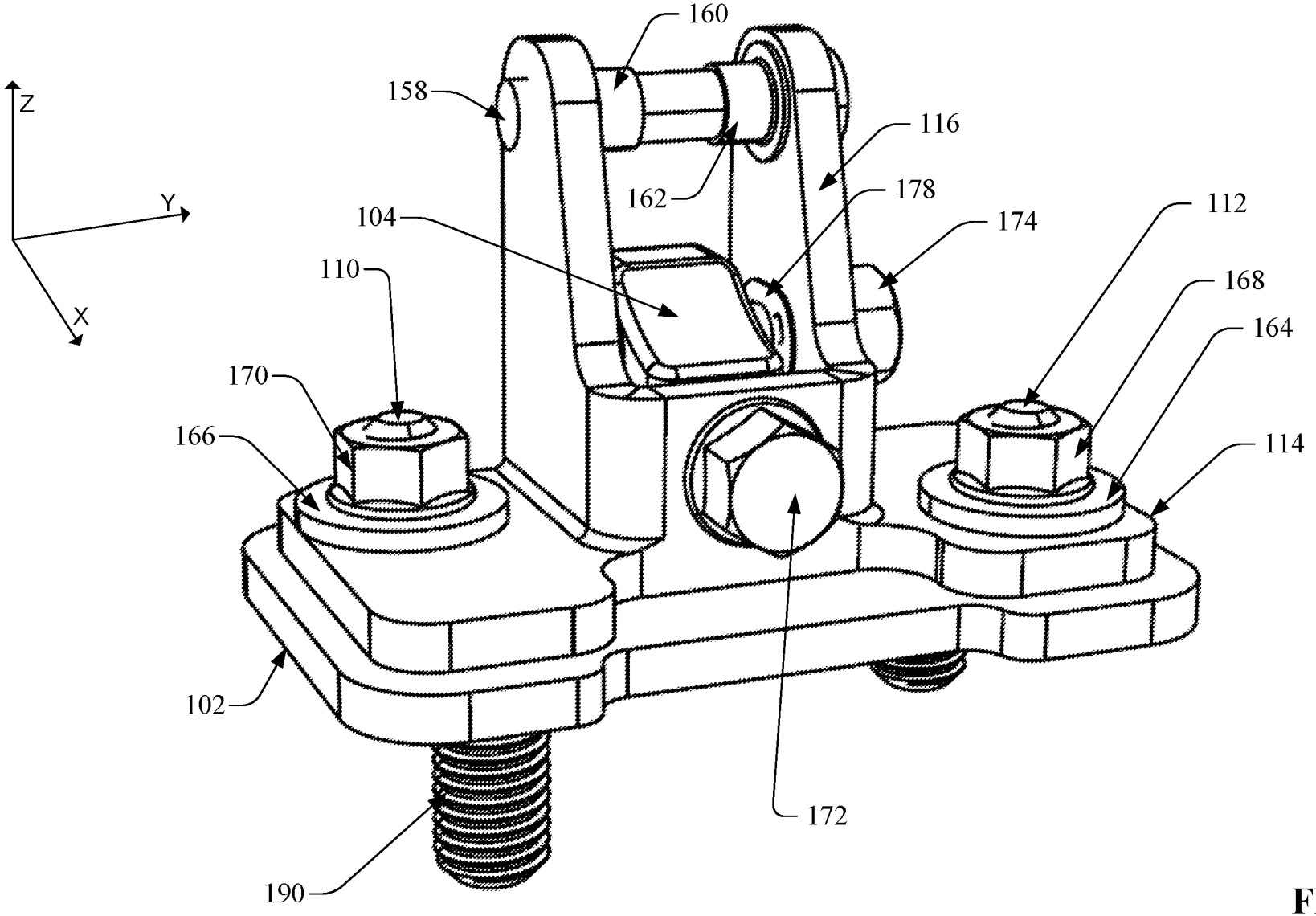
FIG. 6 shows exemplary hinge assembly component(s) in accordance with one or more embodiments described herein.
Figure 17:
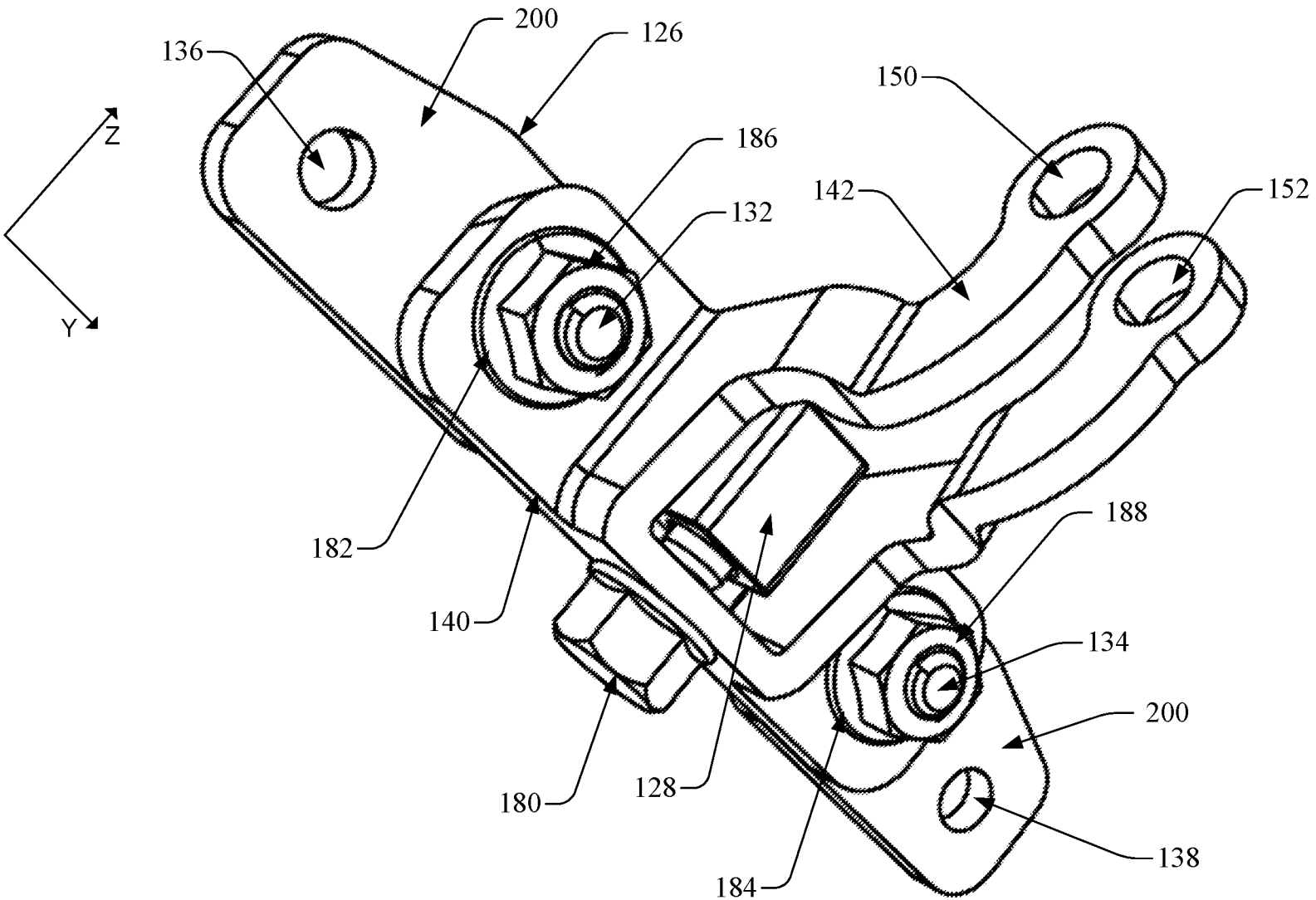
FIG. 17 shows exemplary hinge assembly component(s) in accordance with one or more embodiments described herein.

Turning to FIGS. 5-6, a partially assembled hinge assembly 100 is depicted. In FIGS. 5-6, body-side bushing 160 and body-side bushing 162 (body-side bushings, collectively) can be appreciated. The body-side bushings can be received on the shaft 158 and provide a low-friction surface on which to mount the tailgate-side hinge member 140 at the tailgate-side hinge portion 142. The body-side bushings can comprise a metal (e.g., bronze), a plastic material, PFTE, nylon, acetal, graphite material, or other suitable material type as would be understood by one skilled in the art. In this regard, the body-side bushings can be received between opposing ends of the shaft 158 and the tailgate-side coaxial holes (tailgate-side coaxial hole 150 and tailgate-side coaxial hole 152, collectively which are depicted in FIG. 17). According to an embodiment, a body-side hinge member flat portion 198 of the body-side hinge member 114 can be larger than a body-side base plate flat portion 196 of the body-side base plate 102, which can prevent post-adjustment paint markings or scratches from being visible.

Figure 7:
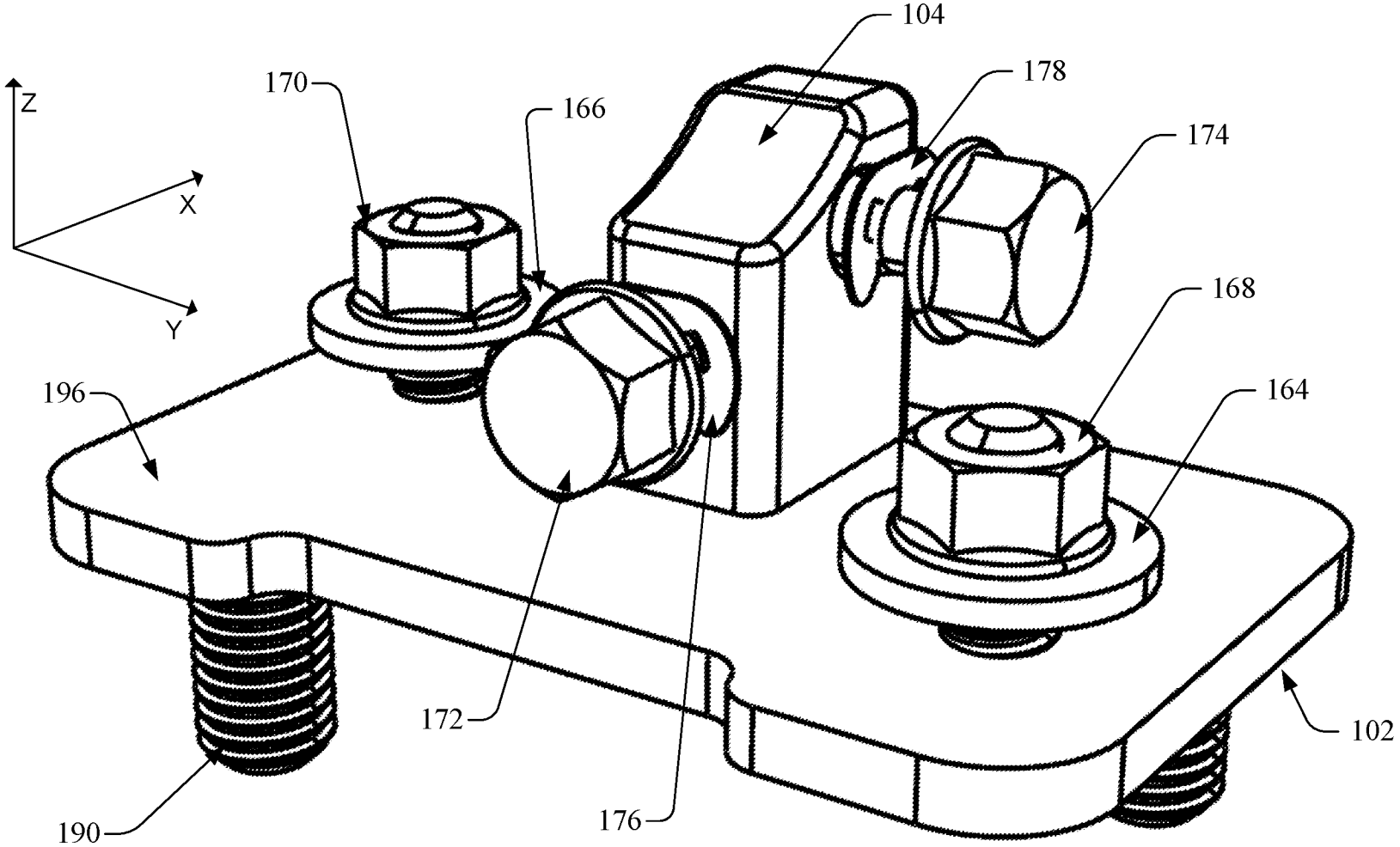
FIG. 7 shows exemplary hinge assembly component(s) in accordance with one or more embodiments described herein.
Figure 8:
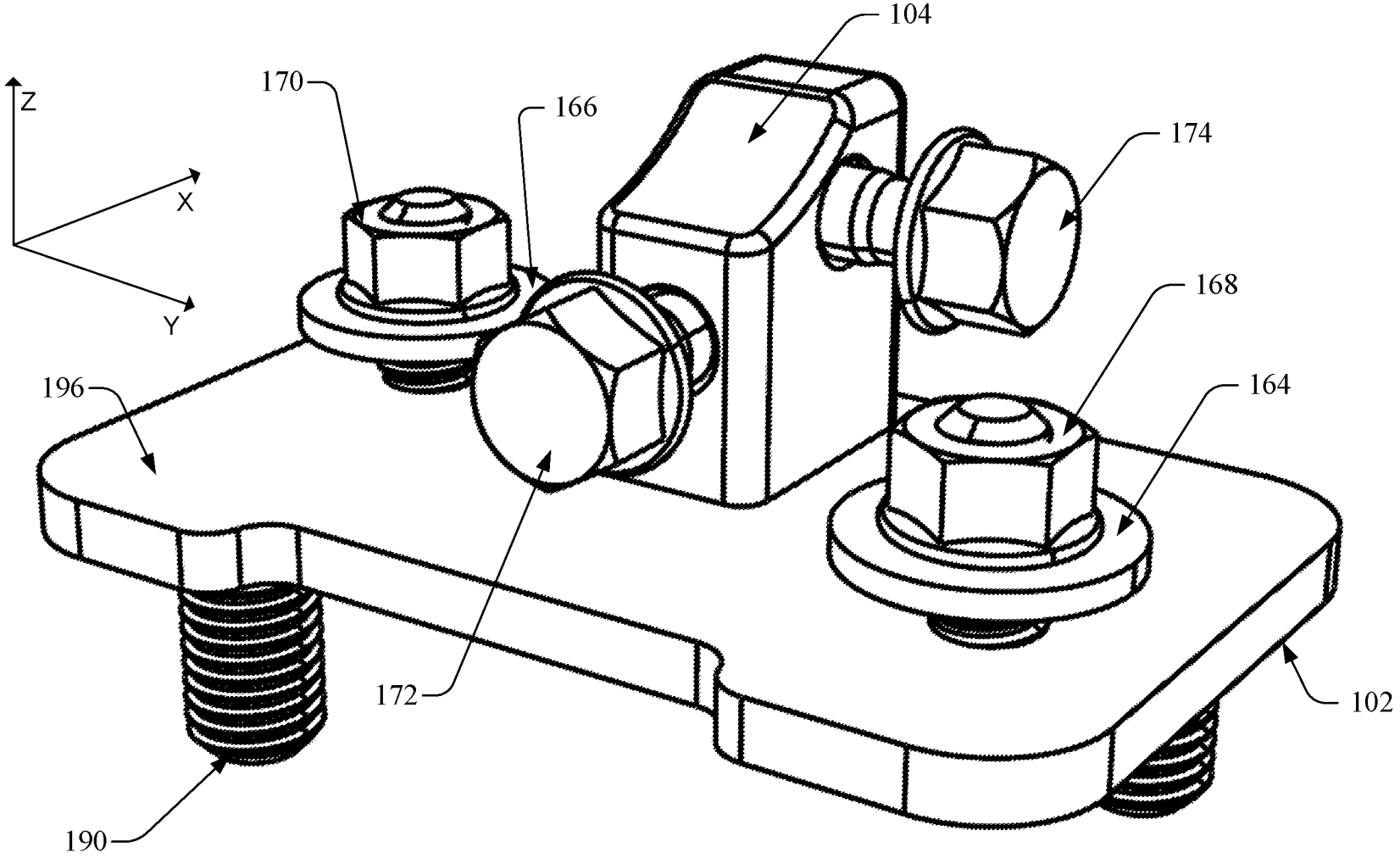
FIG. 8 shows exemplary hinge assembly component(s) in accordance with one or more embodiments described herein.

FIG. 7 illustrates a partially assembled hinge assembly 100. Here, the body-side hinge member 114 is omitted to provide a better view of the body-side adjustment block 104. Additionally, body-side lock ring 176 and body-side lock ring 178 (body-side lock rings, collectively) can be observed. The body-side lock rings can comprise hemispherical lock rings. Body-side lock ring 176 can be used to secure body-side adjustment bolt 172 in body-side adjustment channel 118 of the body-side hinge member 114 (e.g., see FIG. 15). In this regard, the body-side lock ring 176 can be placed on a threaded portion of the body-side adjustment bolt 172, opposite the head of the body-side adjustment bolt 172. In this regard, the head of the body-side adjustment bolt 172 and the body-side lock ring 176 are on opposing sides of the body-side adjustment channel 118, which can promote easy and efficient assembly of the hinge assembly 100. Similarly, body-side lock ring 178 can be used to secure body-side adjustment bolt 174 in body-side adjustment channel 120 of the body-side hinge member 114. In this regard, the body-side lock ring 178 can be placed on a threaded portion of the body-side adjustment bolt 174, opposite the head of the body-side adjustment bolt 174. In this regard, the head of the body-side adjustment bolt 174 and the body-side lock ring 178 are on opposing sides of the body-side adjustment channel 120, which can promote easy and efficient assembly of the hinge assembly 100. According to an embodiment, the body-side hinge member 114 can be pinched between the body-side adjustment bolts and the body-side lock rings. FIG. 8 is similar to FIG. 7, however, FIG. 8 omits the body-side lock rings. It can be appreciated that the body-side lock rings can hold the body-side adjustment bolts in position and enable adjustment of the body-side hinge member 114 relative to the body-side adjustment block 104, without the body-side hinge member 114 being able to move freely relative to the body-side adjustment bolts or the body-side adjustment block 104. According to an embodiment, the body-side lock rings can be received on unthreaded portions of the tailgate-side adjustment bolts. In other embodiments, the tailgate-side adjustment bolts can comprise channels configured for receiving the tailgate-side lock rings.

Figure 9:
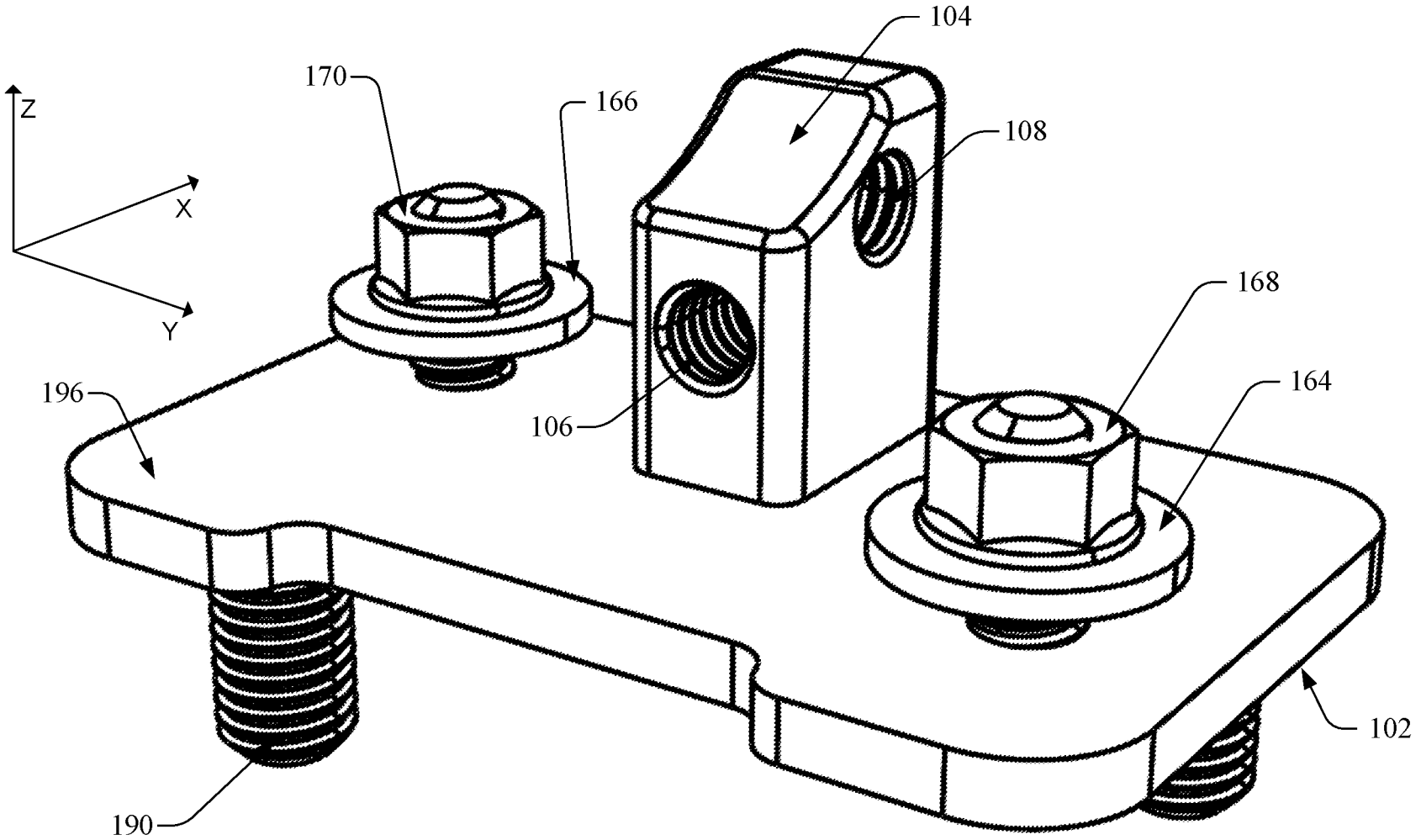
FIG. 9 shows exemplary hinge assembly component(s) in accordance with one or more embodiments described herein.
Figure 10:
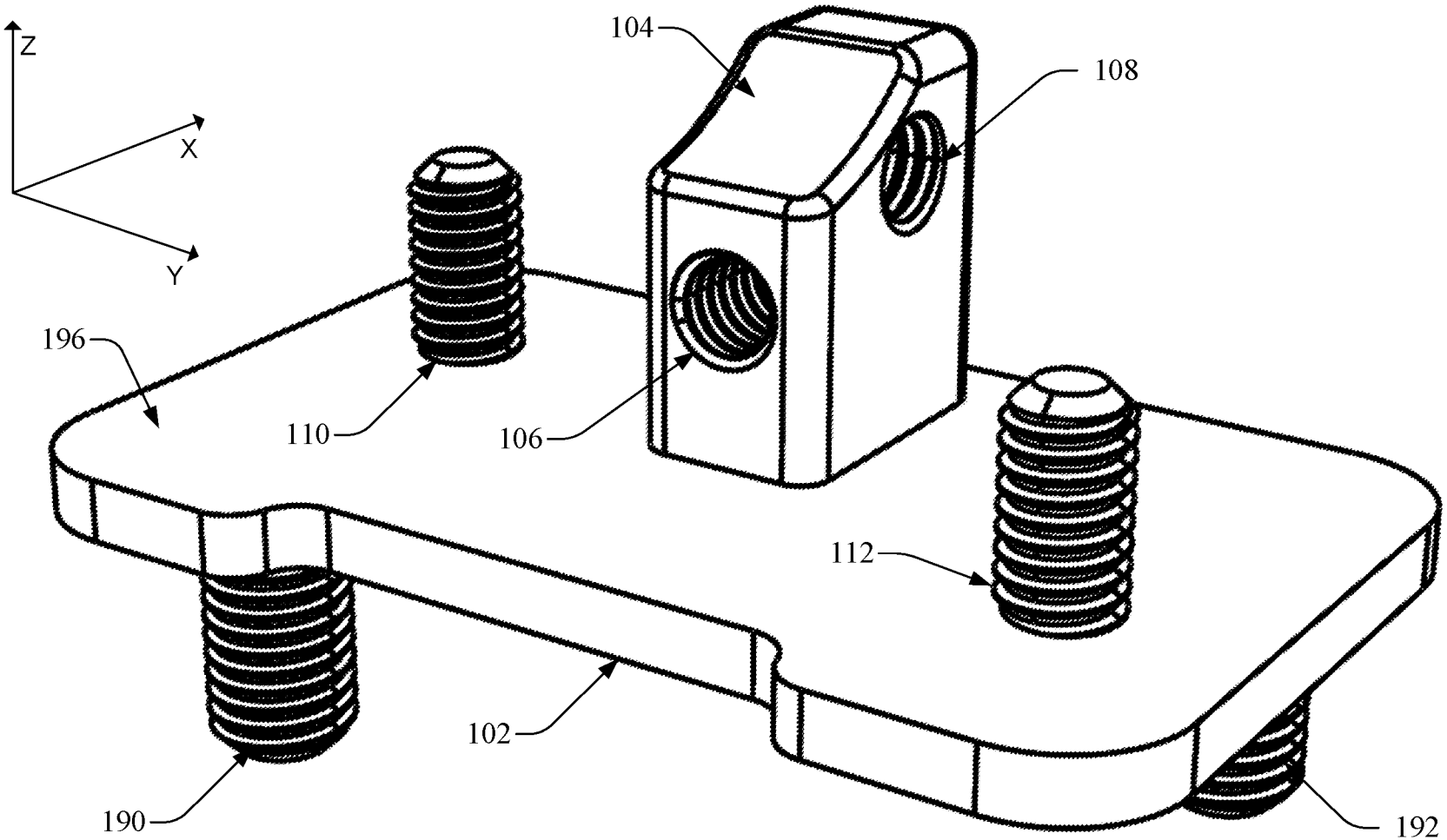
FIG. 10 shows exemplary hinge assembly component(s) in accordance with one or more embodiments described herein.
Figure 11:
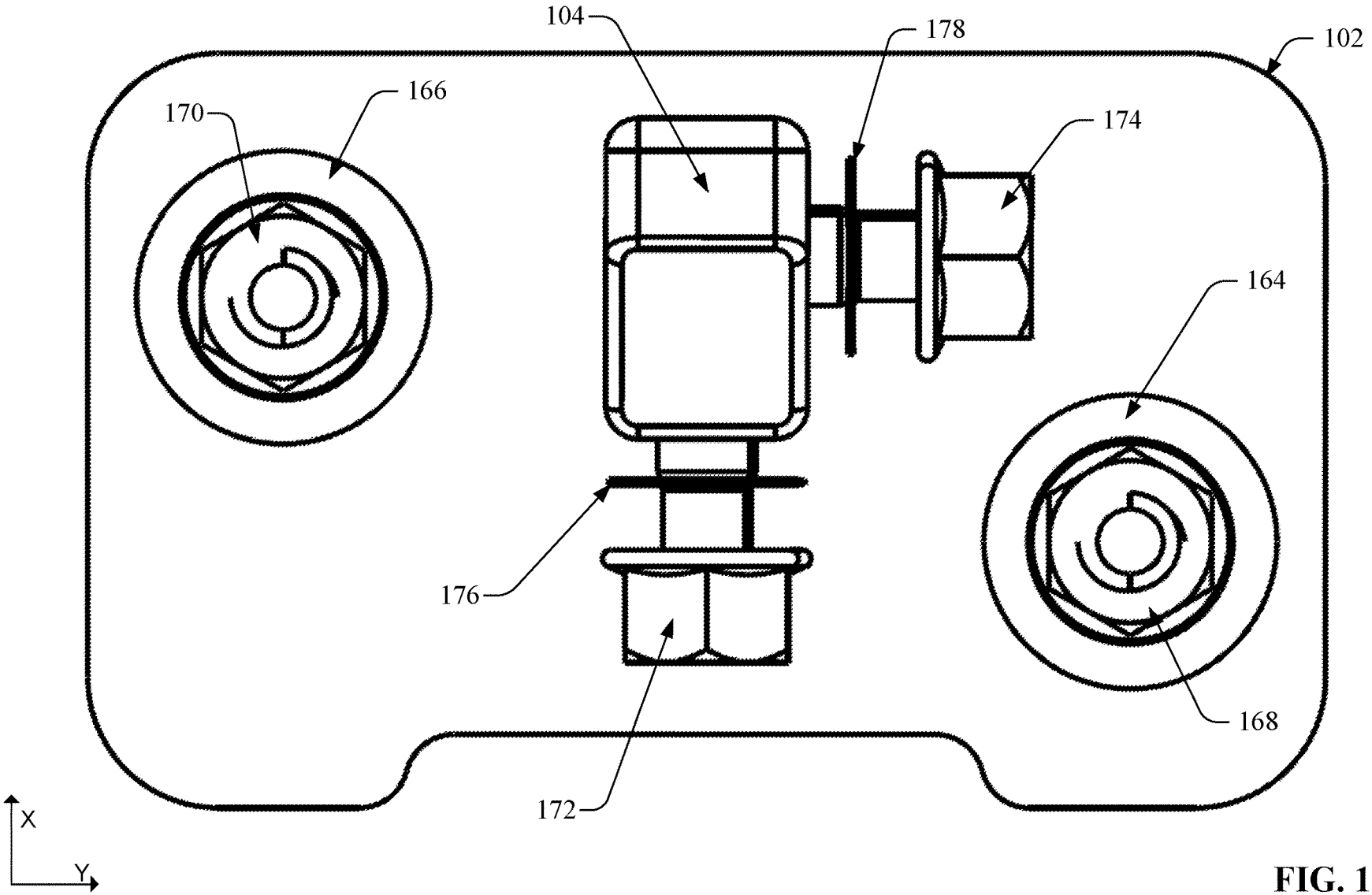
FIG. 11 shows exemplary hinge assembly component(s) in accordance with one or more embodiments described herein.
Figure 12:
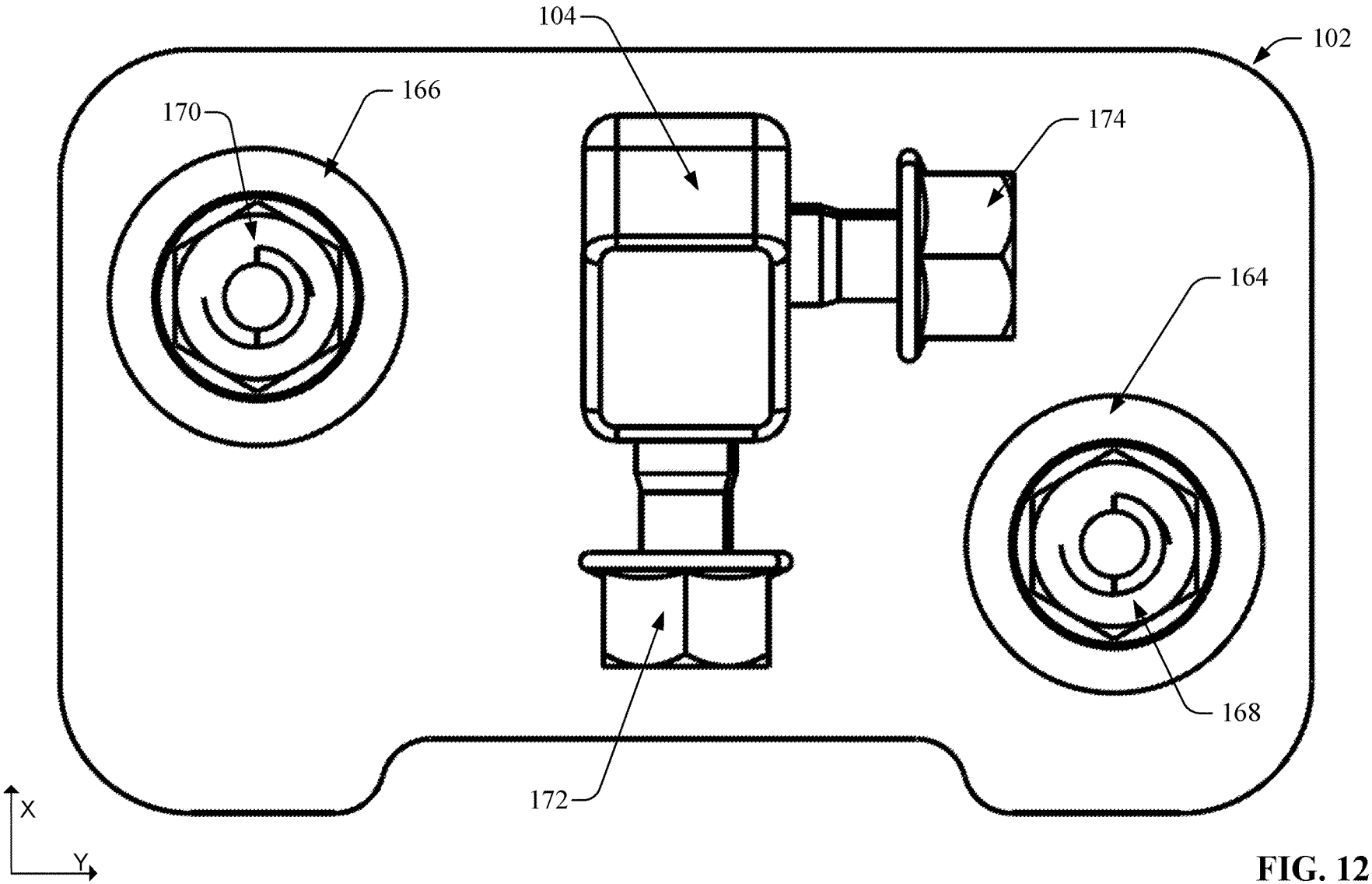
FIG. 12 shows exemplary hinge assembly component(s) in accordance with one or more embodiments described herein.
Figure 13:
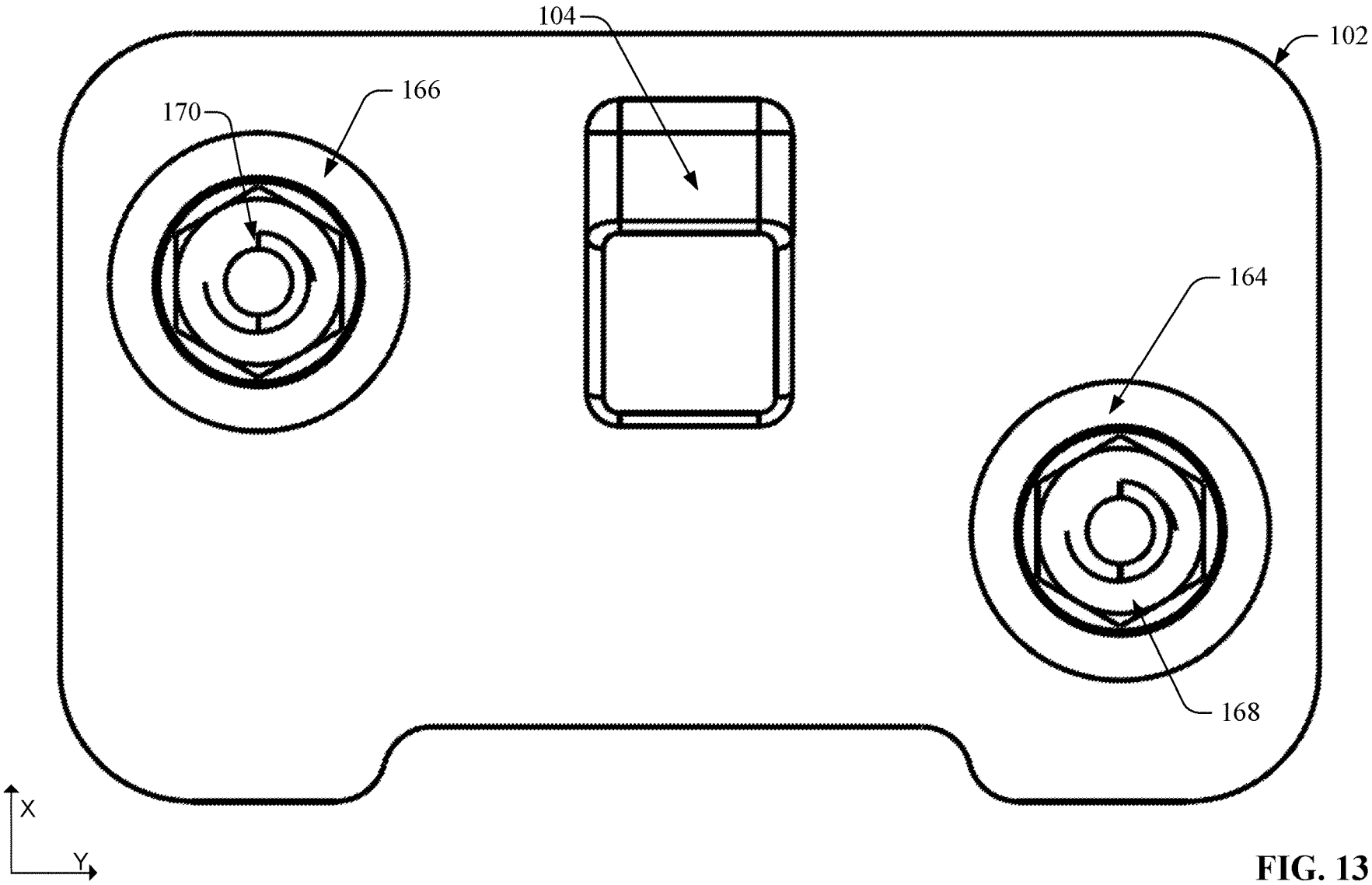
FIG. 13 shows exemplary hinge assembly component(s) in accordance with one or more embodiments described herein.
Figure 14:
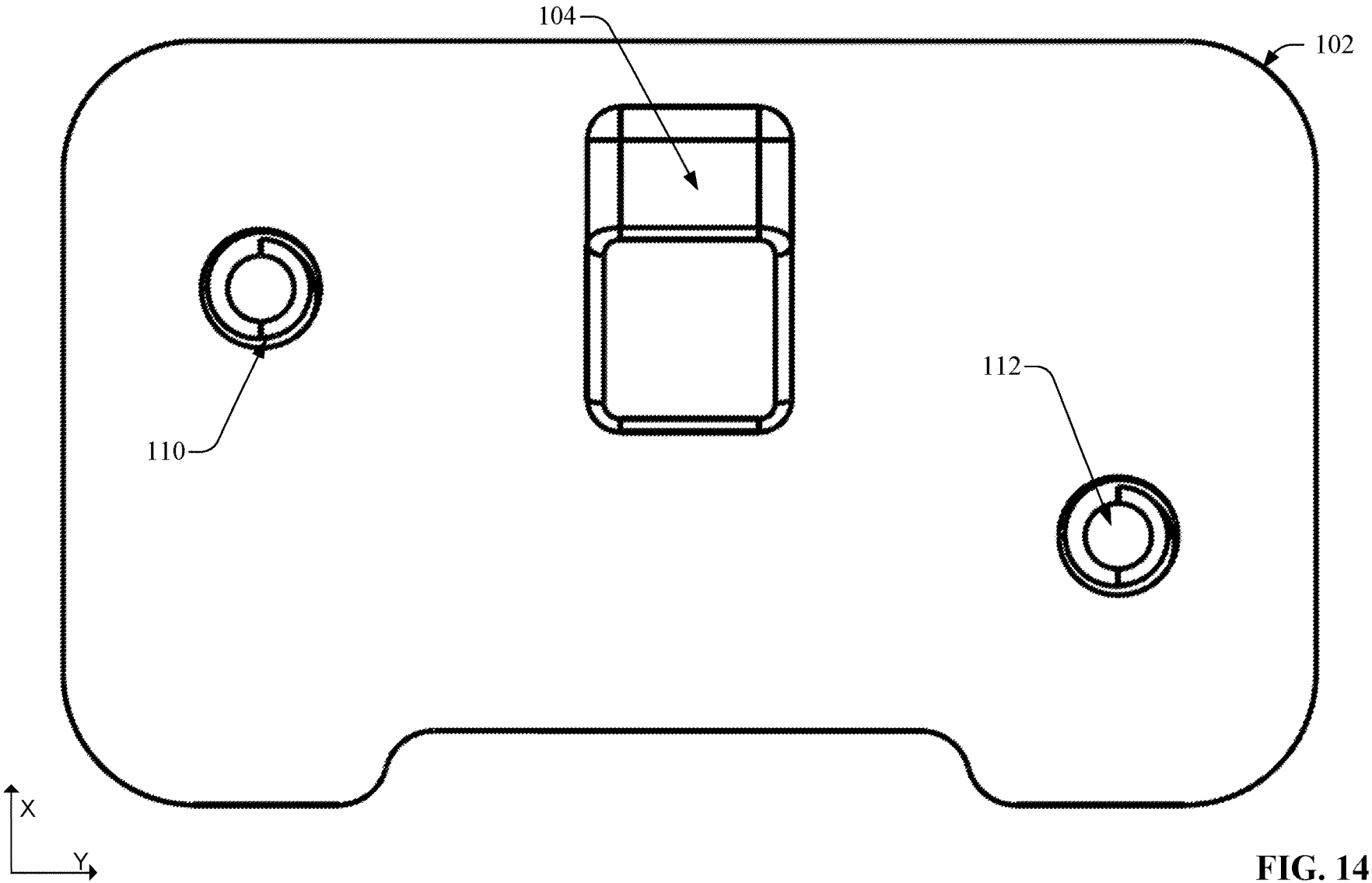
FIG. 14 shows exemplary hinge assembly component(s) in accordance with one or more embodiments described herein.

FIG. 9 is similar to FIG. 8, however, FIG. 9 omits the body-side adjustment bolt 172 and the body-side adjustment bolt 174 (body-side adjustment bolts, collectively). Consequently, body-side threaded hole 106 and body-side threaded hole 108 (body-side threaded holes, collectively) can be appreciated. The body-side threaded holes can be perpendicularly received in the body-side adjustment block 104. According to an embodiment, the body-side threaded hole 106 can have a center axis approximately in the x-direction, and the body-side threaded hole 108 can have a center axis approximately in the y-direction. Body-side adjustment bolt 172 can be threaded to correspond to body-side threaded hole 106. Likewise, body-side adjustment bolt 174 can be threaded to correspond to body-side threaded hole 108. According to an embodiment, the body-side adjustment bolts and the body-side threaded holes all comprise the same thread pattern. It can be appreciated that when the body-side adjustment bolt 172 is engaged in the body-side threaded hole 106, rotation of the body-side adjustment bolt 172 can facilitate adjustment of the body-side hinge member 114 in the x-direction. Similarly, it can be appreciated that when the body-side adjustment bolt 174 is engaged in the body-side threaded hole 108, rotation of the body-side adjustment bolt 174 can facilitate adjustment of the body-side hinge member 114 in the y-direction. However, adjustment of the body-side hinge member 114 relative to the body-side base plate 102 can be prevented by tightening of one of more of the body-side locking nuts. In this regard, the body-side hinge member 114 can be immovably pinched against the body-side base plate 102. Adjustment of the body-side hinge member 114 relative to the body-side base plate 102 can be enabled by loosening of the body-side locking nuts. FIG. 10 is similar to FIG. 9, but omits the body-side locking nuts, and also omits the body-side washer 164 and body-side washer 166 (body-side washers, collectively) for purposes of visualization. FIGS. 11-14 provide an alternative, overhead view of various states of construction/deconstruction of the hinge assembly 100 similar to FIGS. 7-10.

Figure 15:
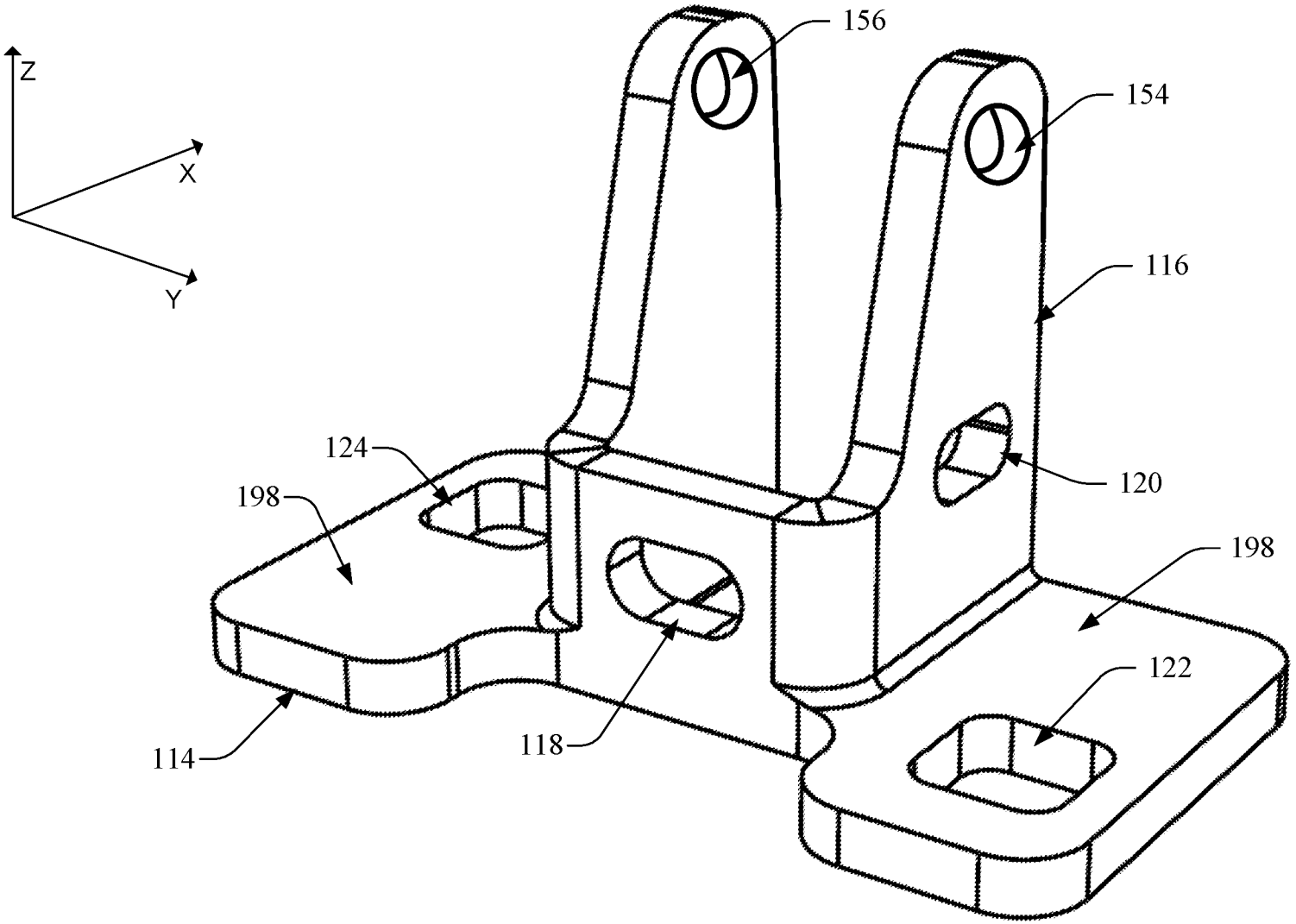
FIG. 15 shows exemplary hinge assembly component(s) in accordance with one or more embodiments described herein.

With reference to FIG. 15, the body-side hinge member 114 is illustrated. FIG. 15 provides a clearer view of the body-side adjustment hole 122 and body-side adjustment hole 124 (body-side adjustment holes, collectively), body-side adjustment channel 118 and body-side adjustment channel 120 (body-side adjustment channels, collectively), and body-side coaxial hole 154 and body-side coaxial hole 156 (body-side coaxial holes, collectively). The body-side adjustment holes can be enlarged to permit x-direction and/or y-direction adjustment of the body-side hinge member 114 relative to the body-side base plate 102 when the body-side locking nuts are loosened. In this regard, the body-side adjustment holes are configured to be larger than a diameter of the shafts of the body-side locking studs, such that x-direction and y-direction movement of the body-side hinge member 114 is permitted when the body-side hinge member 114 is received on the body-side locking studs and the body-side locking nuts are sufficiently loosened to enable movement of the body-side hinge member 114. It can be appreciated that the body-side washers (body-side washer 164 and body-side washer 166, collectively) can be larger than the body-side adjustment holes. In this regard, the body-side washers can completely cover the body-side adjustment holes, such that the body-side adjustment holes are protected from debris entry and that hinge assembly 100 is more cosmetically appealing and/or facilitate tightening of the body-side locking nuts to an appropriate torque for the hinge assembly 100.

The body-side adjustment channel 118 is configured such that during rotation of the body-side adjustment bolt 174 which facilitates precise adjustment of the body-side hinge member 114 in the y-direction, the body-side adjustment bolt 172 will not interfere with movement in the y-direction due to the slotted nature of the body-side adjustment channel 118. Similarly, the body-side adjustment channel 120 is configured such that during rotation of the body-side adjustment bolt 172 which facilitates precise adjustment of the body-side hinge member 114 in the x-direction, the body-side adjustment bolt 174 will not interfere with movement in the x-direction due to the slotted nature of the body-side adjustment channel 120.

Figure 16:
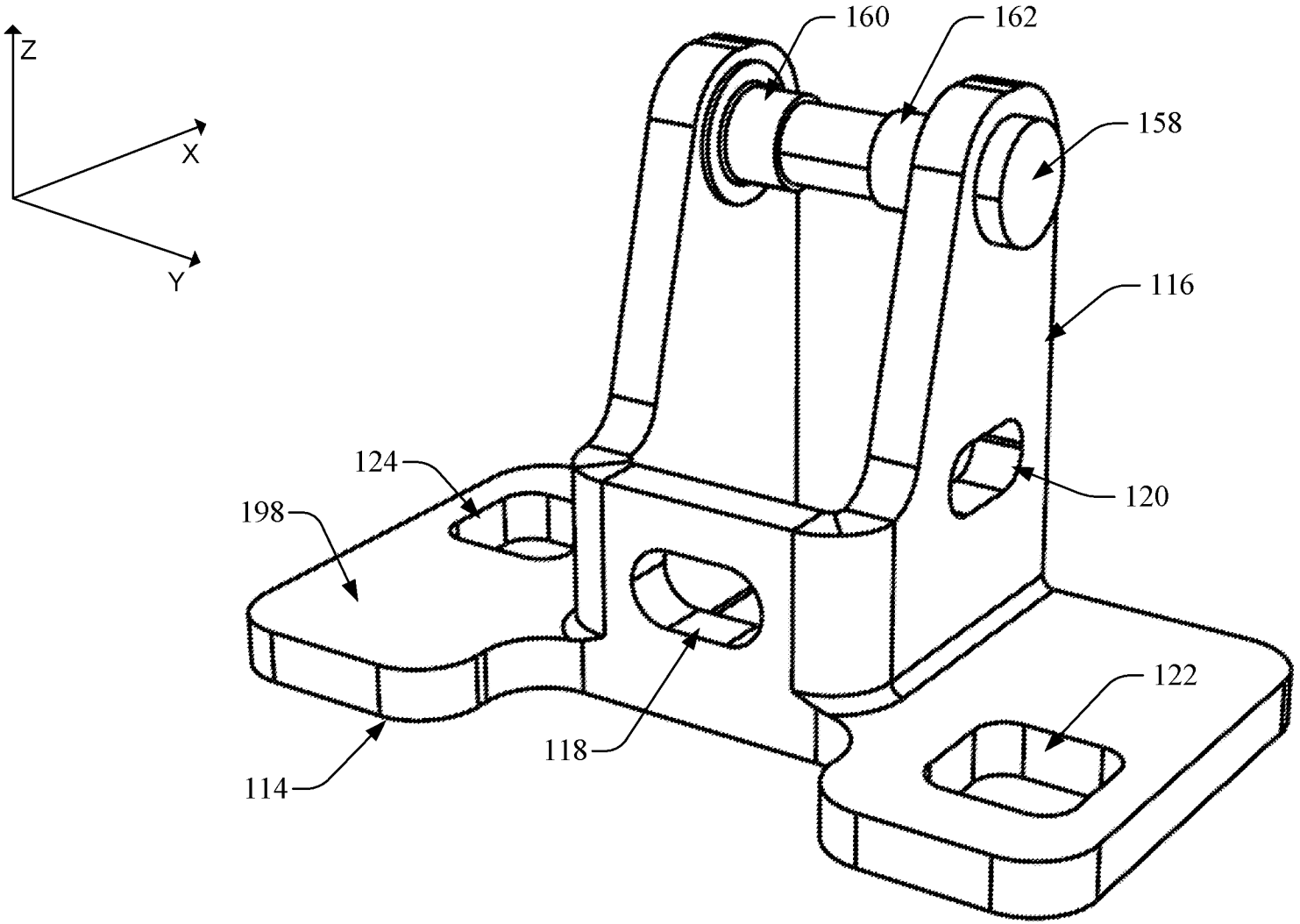
FIG. 16 shows exemplary hinge assembly component(s) in accordance with one or more embodiments described herein.

As shown in FIG. 16, the body-side coaxial holes can be configured to receive the shaft 158 as shown in FIG. 16. It can be appreciated that the shaft 158 can be press-fit into one or more of the coaxial holes.

Turning now to FIG. 17, there is illustrated a partially assembled hinge assembly 100. FIG. 17 illustrates tailgate-side base plate 126 as attached to tailgate-side hinge member 140. The tailgate-side base plate 126 can be configured to be mounted to a vehicle tailgate. Tailgate-side base plate 126 can comprise a tailgate-side locking stud 132 and a tailgate-side locking stud 134 (tailgate-side locking studs, collectively). The tailgate-side locking studs can be located on a top side of the tailgate-side base plate 126 and can extend perpendicularly away from a surface of a tailgate-side base plate flat portion 200 of the tailgate-side base plate 126. According to an embodiment, the tailgate-side locking studs can be welded to the top side of the tailgate-side base plate 126. In other embodiments, the tailgate-side locking studs can be milled or otherwise machined. The tailgate-side base plate 126 can comprise a tailgate mounting hole 136 and a tailgate mounting hole 138 (tailgate mounting holes, collectively). The tailgate mounting holes can be utilized to mount the tailgate-side base plate 126 to a vehicle tailgate. The tailgate-side base plate 126 can additionally comprise a tailgate-side adjustment block 128 which will be later discussed in greater detail. It can be appreciated that the tailgate-side adjustment block 128 can extend perpendicularly away from a surface of the tailgate-side base plate flat portion 200.

The tailgate-side hinge member 140 can be adjustably received atop the tailgate-side base plate 126. The tailgate-side hinge member flat portion 202 of the tailgate-side hinge member 140 can be configured to be substantially coplanar with tailgate-side base plate flat portion 200. In this regard, a bottom side of the tailgate-side hinge member 140 can be flat and can be coplanar with a top side of the tailgate-side base plate 126. Tailgate-side locking nut 186 can be configured to thread onto the tailgate-side locking stud 132. In this regard, the tailgate-side locking nut 186 and tailgate-side locking stud 132 can comprise corresponding thread patterns. Similarly, tailgate-side locking nut 188 can be configured to thread onto the tailgate-side locking stud 134. In this regard, the tailgate-side locking nut 188 and tailgate-side locking stud 134 can comprise corresponding thread patterns. Tailgate-side washer 182 can be received between the tailgate-side hinge member 140 and the tailgate-side locking nut 186. Likewise, tailgate-side washer 184 can be received between the tailgate-side hinge member 140 and the tailgate-side locking nut 188. In other embodiments, tailgate-side washer 182 and tailgate-side locking nut 186 can be integrated, wherein the tailgate-side locking nut 186 comprises a flange nut with a washer-like flange disposed at one end of the tailgate-side locking nut 186. Likewise, tailgate-side washer 184 and tailgate-side locking nut 188 can be integrated, wherein the tailgate-side locking nut 188 comprises a flange nut with a washer-like flange disposed at one end of the tailgate-side locking nut 188. It can be appreciated that tightening of the tailgate-side locking nuts (tailgate-side locking nut 186 and tailgate-side locking nut 188, collectively) can prevent movement of the tailgate-side hinge member 140 relative to the tailgate-side base plate 126. A grease, oil, or other pretreatment to facilitate a low-friction EC coating process and/or enable easier adjustment can be provided between the tailgate-side hinge member 140 and tailgate-side base plate 126 to facilitate easier adjustment. It can be appreciated that an oil or grease can be applied in/on any component of the hinge assembly 100. In this regard, the tailgate-side hinge member 140 can be immovably pinched against the tailgate-side base plate 126. Similarly, loosening of the tailgate-side locking nuts can allow for the tailgate-side hinge member 140 to be adjusted in a z-direction (e.g., a third direction) relative to the tailgate-side base plate 126. It can be appreciated that edges of tailgate-side base plate 126, tailgate-side hinge member 140, and/or other components of the hinge assembly 100 can comprise small radii to facilitate ease of movement/adjustment. Adjustment of the tailgate-side hinge member 140 relative to the tailgate-side base plate 126 is later discussed in greater detail. It can be appreciated that the x, y, and z directions can be approximately orthogonal to each other, although this relationship may change depending on degree of the hinge assembly 100 being in an open position, closed position, or somewhere in-between.

According to an embodiment, one or more of the tailgate-side mounting studs or the body-side mounting studs can be replaced with bolts which can be threaded to accept nuts. Additionally, it can be appreciated that bolt heads of bolts described herein and nuts described herein can comprise approximately the same shape and size, such that one size of a hexagonal wrench or socket can be utilized to mount and/or adjust the hinge assembly 100.

Figure 18:
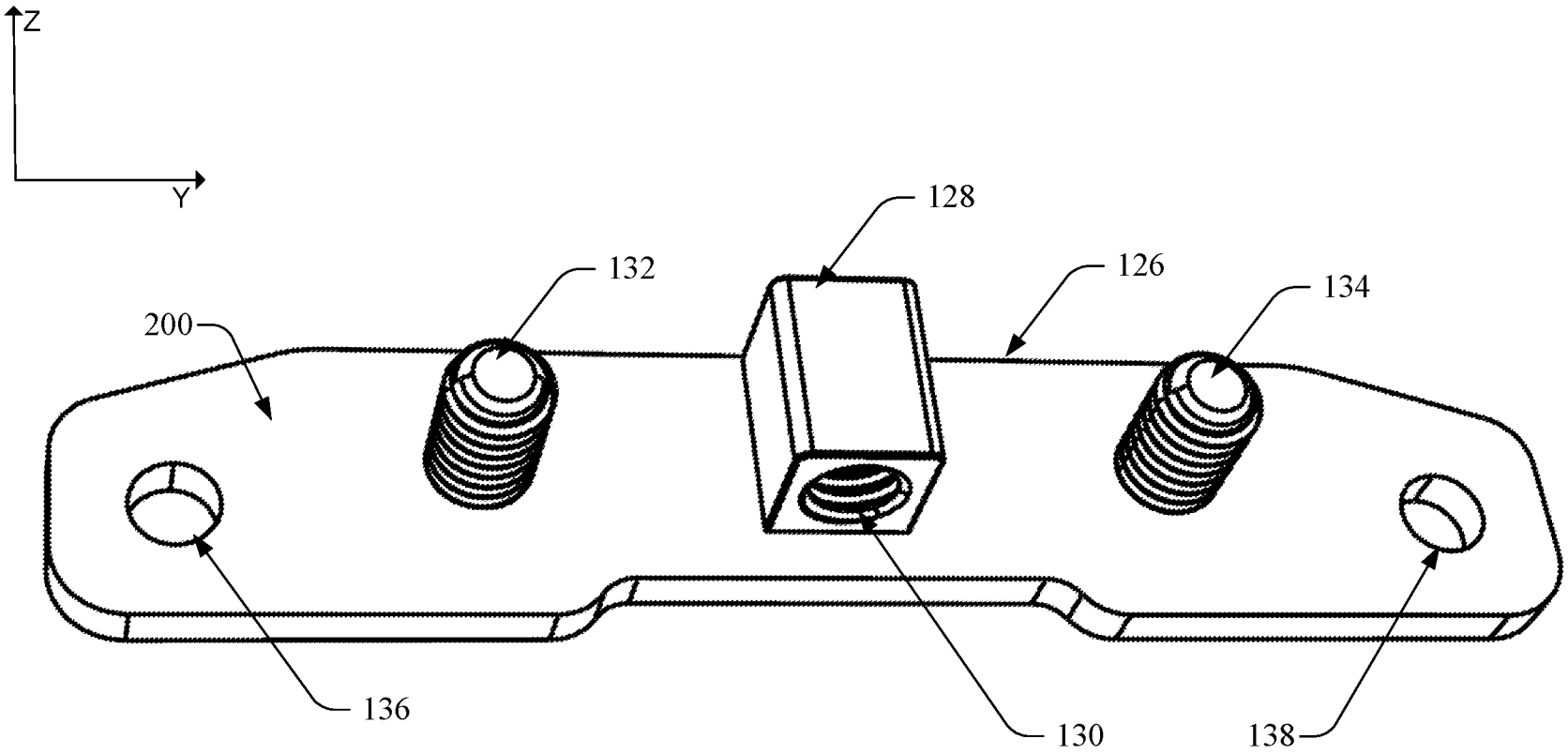
FIG. 18 shows exemplary hinge assembly component(s) in accordance with one or more embodiments described herein.
Figure 19:
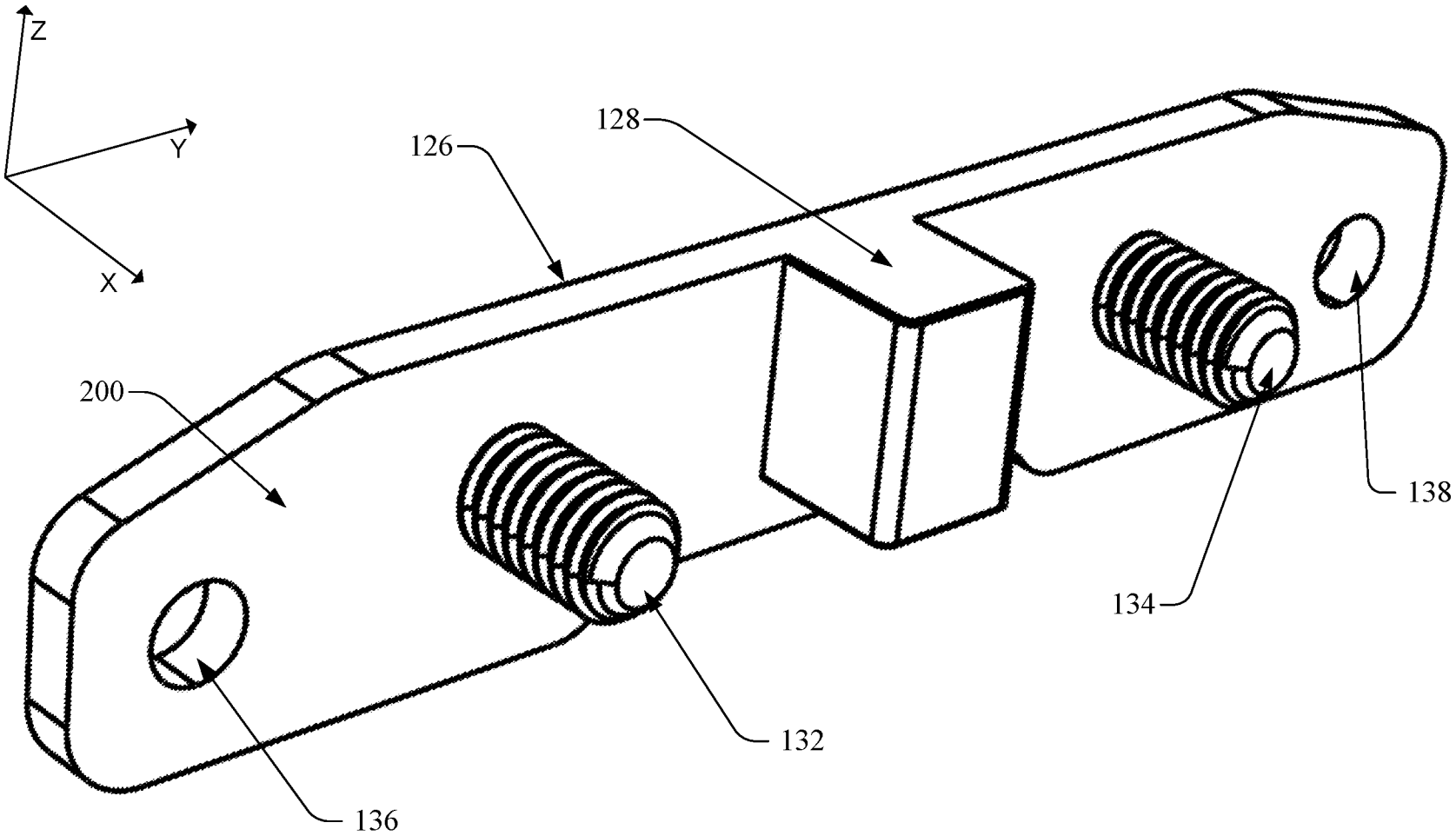
FIG. 19 shows exemplary hinge assembly component(s) in accordance with one or more embodiments described herein.
Figure 20:
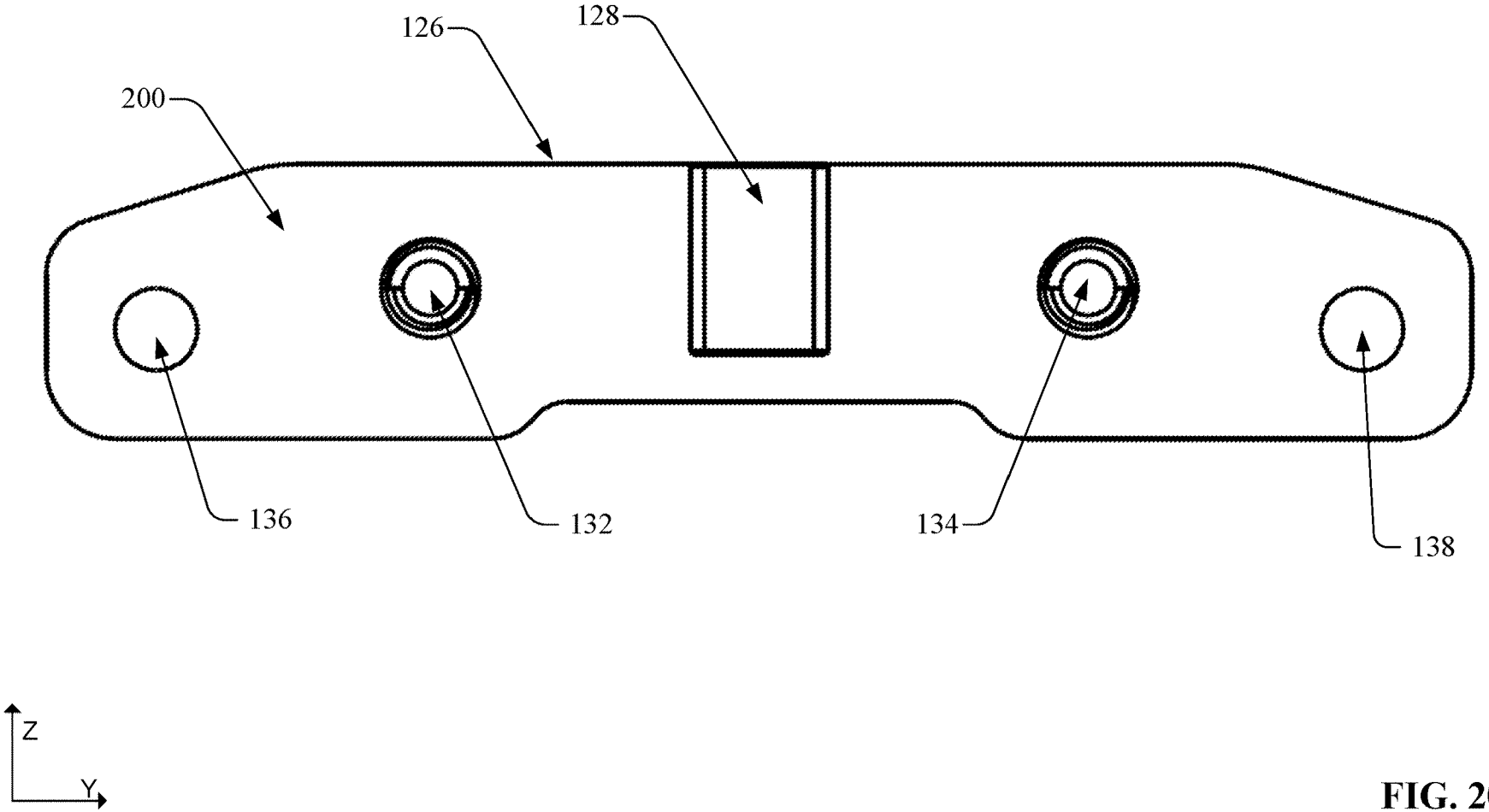
FIG. 20 shows exemplary hinge assembly component(s) in accordance with one or more embodiments described herein.

With reference to FIG. 18, the tailgate-side base plate 126 is shown by itself, which allows for easier depiction of the tailgate-side threaded hole 130. The tailgate-side threaded hole 130 can be received in the tailgate-side adjustment block 128. According to an embodiment, the tailgate-side threaded hole 130 can have a center axis approximately in the z-direction. Tailgate-side adjustment bolt 180 can be threaded to correspond to the tailgate-side threaded hole 130. According to an embodiment, all of the tailgate-side adjustment bolt 180, tailgate-side threaded hole 130, body-side adjustment bolts, and body-side threaded holes all comprise the same thread pattern. It can be appreciated that when the tailgate-side adjustment bolt 180 is threaded into the tailgate-side threaded hole 130, rotation of the tailgate-side adjustment bolt 180 can facilitate adjustment of the tailgate-side hinge member 140 in the z-direction. However, adjustment of the tailgate-side hinge member 140 relative to the tailgate-side base plate 126 can be prevented by tightening of one or more of the tailgate-side locking nuts. Adjustment of the tailgate-side hinge member 140 relative to the tailgate-side base plate 126 can be enabled by loosening of the tailgate-side locking nuts. FIGS. 19-20 depict alternative viewing angles of the tailgate-side base plate 126.

Figure 21:
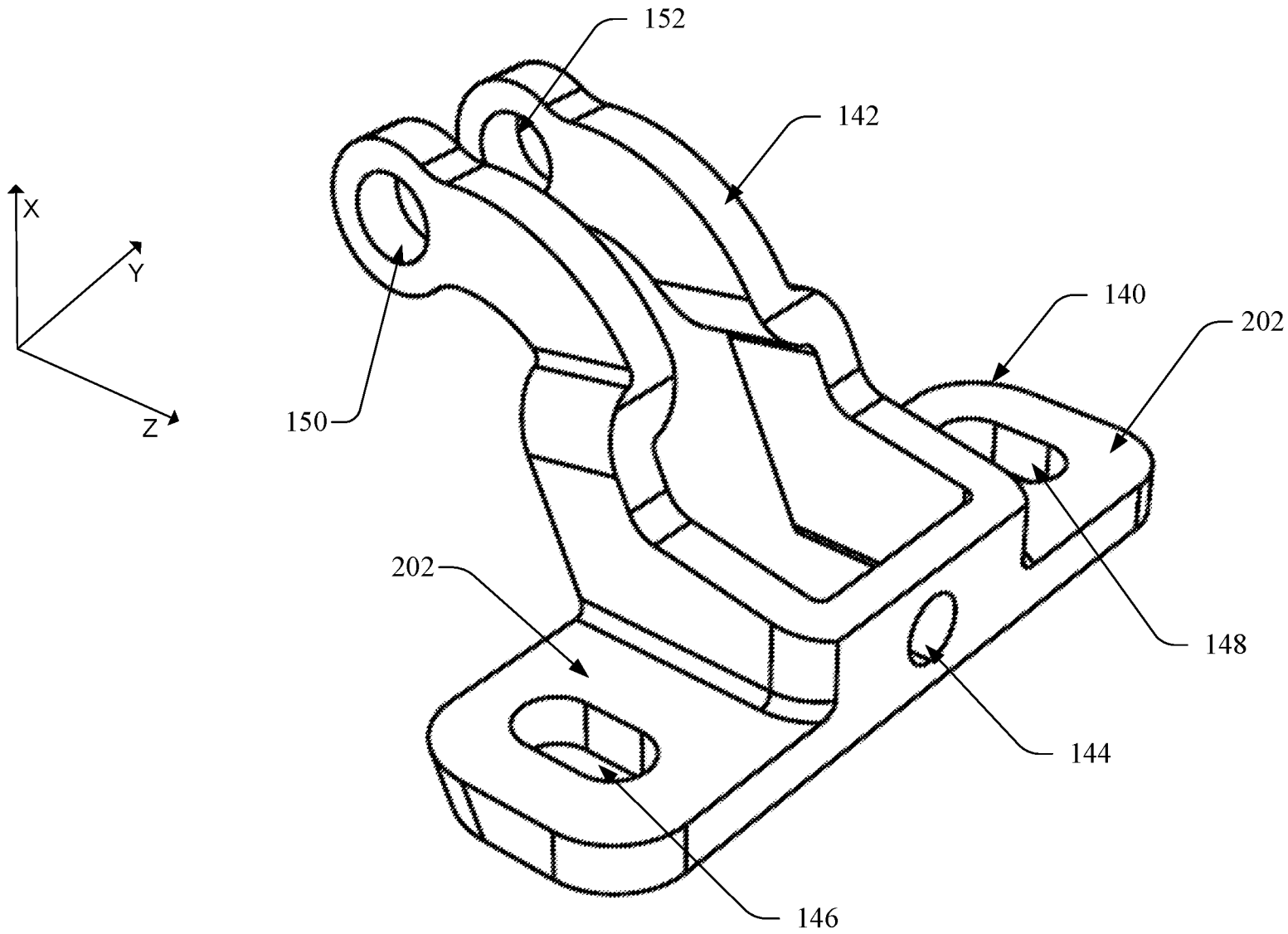
FIG. 21 shows exemplary hinge assembly component(s) in accordance with one or more embodiments described herein.
Figure 22:
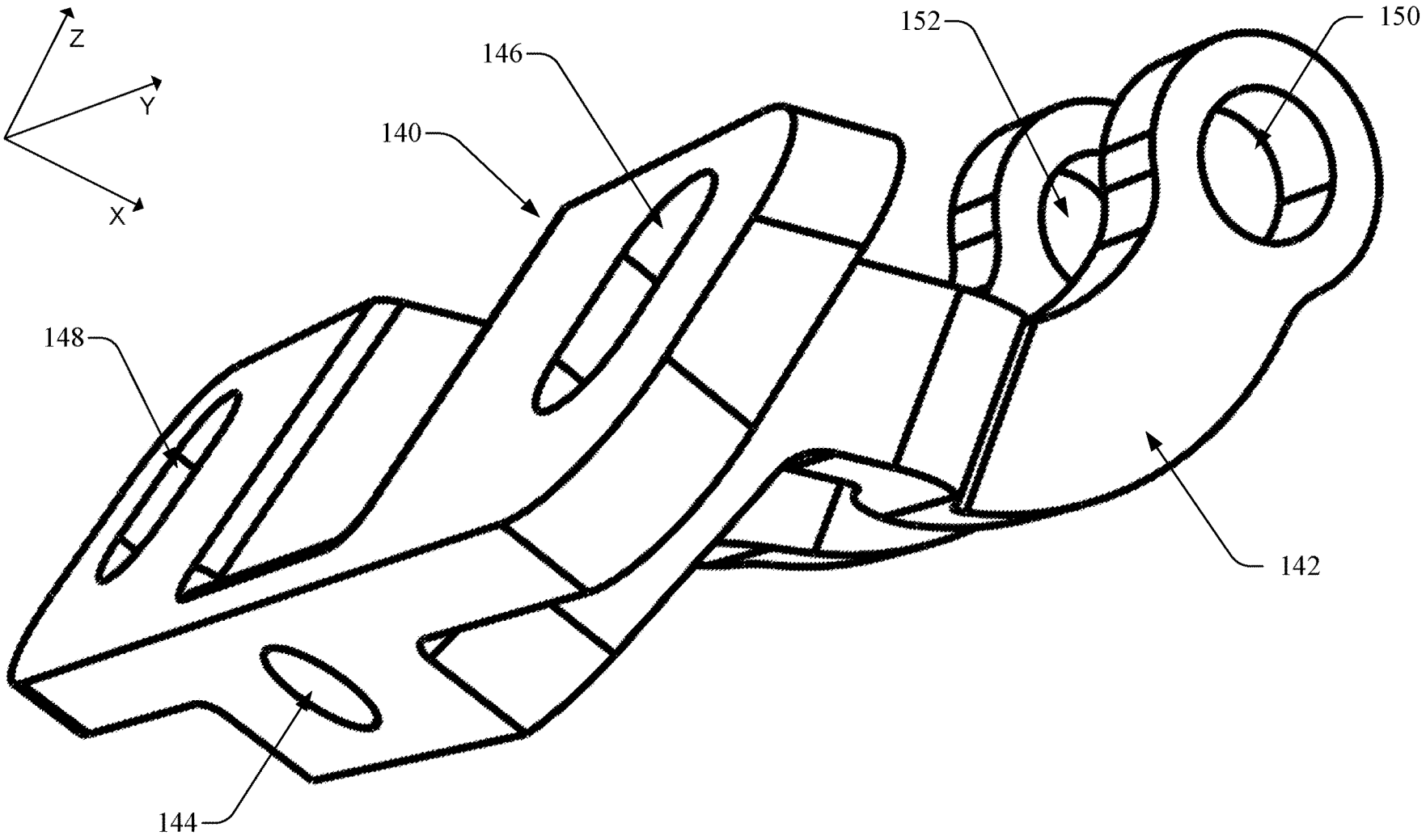
FIG. 22 shows exemplary hinge assembly component(s) in accordance with one or more embodiments described herein.

Turning now to FIG. 21, the tailgate-side hinge member 140 is depicted alone, which allows for easier visualization of the tailgate-side adjustment channel 146 and tailgate-side adjustment channel 148 (tailgate-side adjustment channels, collectively) and the tailgate-side adjustment hole 144. The tailgate-side adjustment channels can be slotted in the z-direction to permit z-direction movement of the tailgate-side hinge member 140 relative to the tailgate-side base plate 126 when the tailgate-side locking nuts are loosened. Tailgate-side coaxial hole 150 and tailgate-side coaxial hole 152 can be received through a tailgate-side hinge portion 142 of the tailgate-side hinge member 140. The tailgate-side coaxial holes can be configured to receive the shaft 158. FIG. 22 provides an alternate viewing angle of the tailgate-side hinge member 140.

It can be appreciated that the tailgate-side washers (tailgate-side washer 182 and tailgate-side washer 184, collectively) can be larger than the tailgate-side adjustment channels. In this regard, the tailgate-side washers can completely cover the tailgate-side adjustment channels, such that the tailgate-side adjustment channels are protected from debris entry and that hinge assembly 100 is more cosmetically appealing. Additionally, though the tailgate-side hinge portion 142 features two arms (and thus two tailgate-side coaxial holes), it can be appreciated that in other embodiments (not depicted for sake of brevity), the tailgate-side hinge portion can comprise only one arm, and thus comprise only one tailgate-side coaxial hole (e.g., tailgate-side coaxial hole 150).

Figure 23:
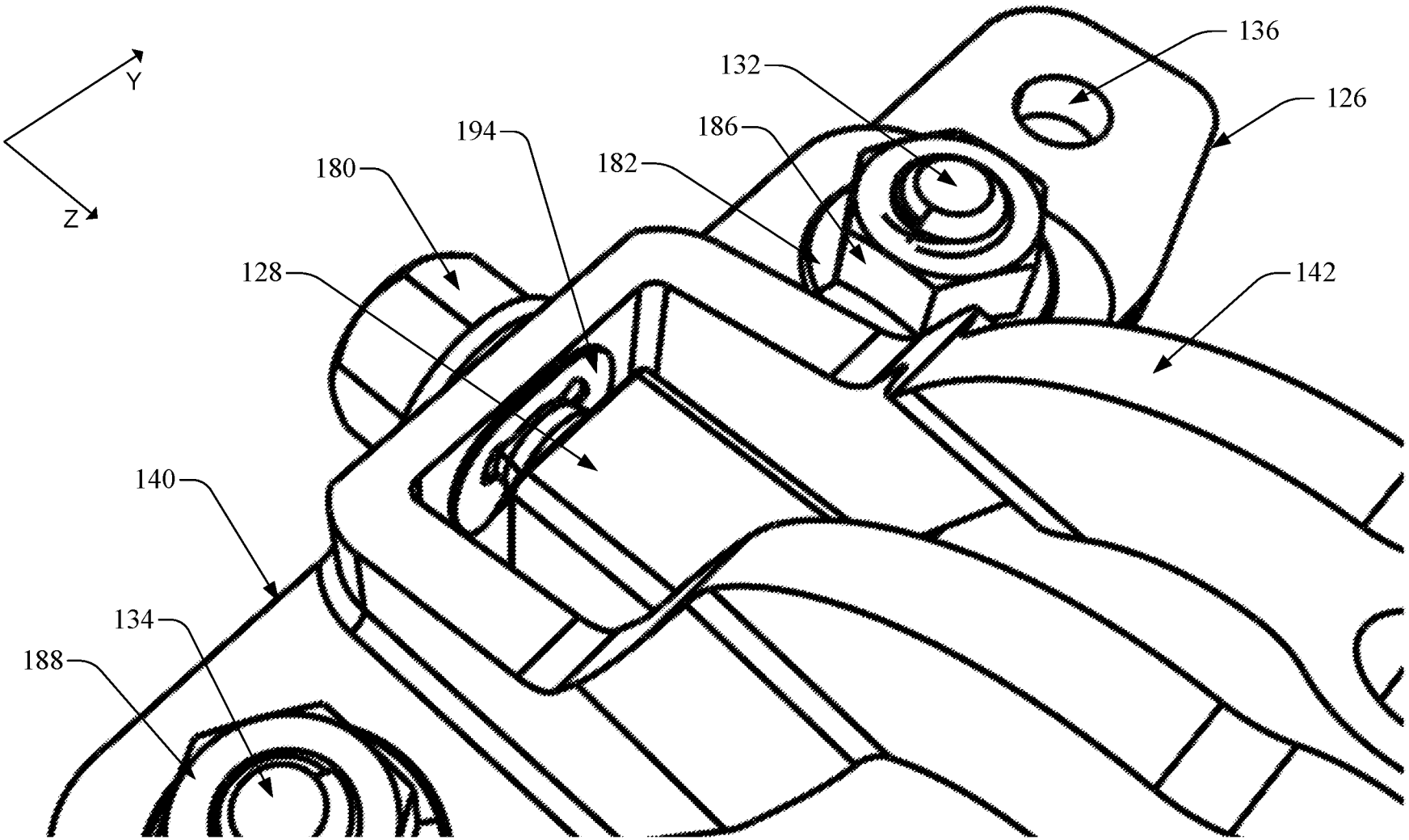
FIG. 23 shows exemplary hinge assembly component(s) in accordance with one or more embodiments described herein.

In FIG. 23, the tailgate-side lock ring 194 is viewable. The tailgate-side lock ring 194 can comprise a hemispherical lock ring. The tailgate-side lock ring 194 can be used to secure the tailgate-side adjustment bolt 180 in the tailgate-side adjustment hole 144 of the tailgate-side hinge member 140. In this regard, the tailgate-side lock ring 194 can be placed on a threaded portion of the tailgate-side adjustment bolt 180, opposite the head of the tailgate-side adjustment bolt 180. In this regard, the head of the tailgate-side adjustment bolt 180 and the tailgate-side lock ring 194 are on opposing sides of the tailgate-side adjustment hole 144, which can promote easy and efficient assembly of the hinge member assembly 100. According to an embodiment, the tailgate-side hinge member 140 can be pinched between the tailgate-side adjustment bolt 180 and the tailgate-side lock ring 194. It can be appreciated that the tailgate-side lock ring 194 can hold the tailgate-side adjustment bolt 180 in position and enable adjustment of the tailgate-side hinge member 140 relative to the tailgate-side adjustment block 128, without the tailgate-side hinge member 140 being able to move freely relative to the tailgate-side adjustment bolt 180 or the tailgate-side adjustment block 128. According to an embodiment, the tailgate-side lock ring 194 can be received on an unthreaded portion of the tailgate-side adjustment bolt 180. In other embodiments, the tailgate-side adjustment bolt 180 can comprise a channel configured for receiving the tailgate-side lock ring 194.

Figure 24:
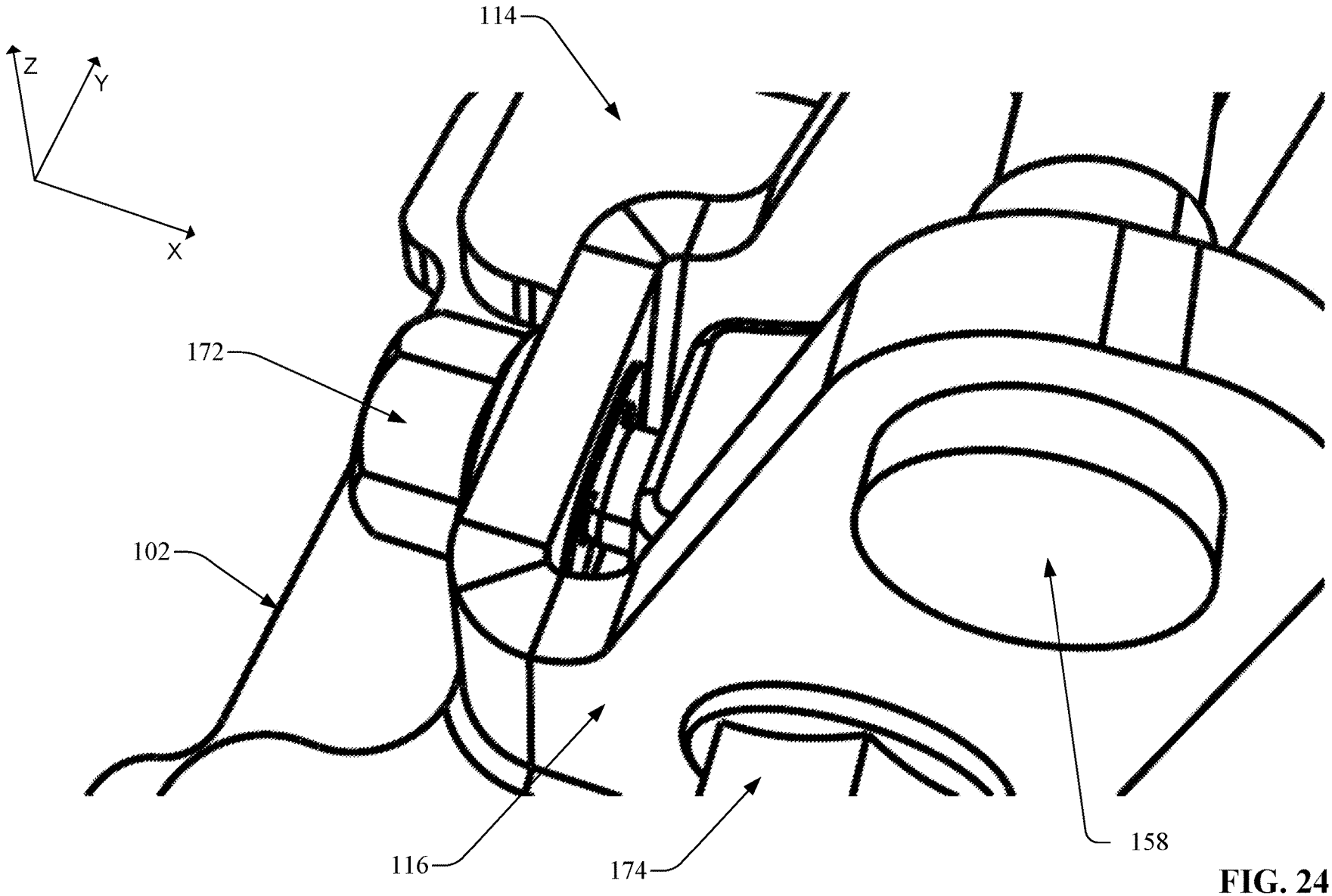
FIG. 24 shows exemplary hinge assembly component(s) in accordance with one or more embodiments described herein.
Figure 25:
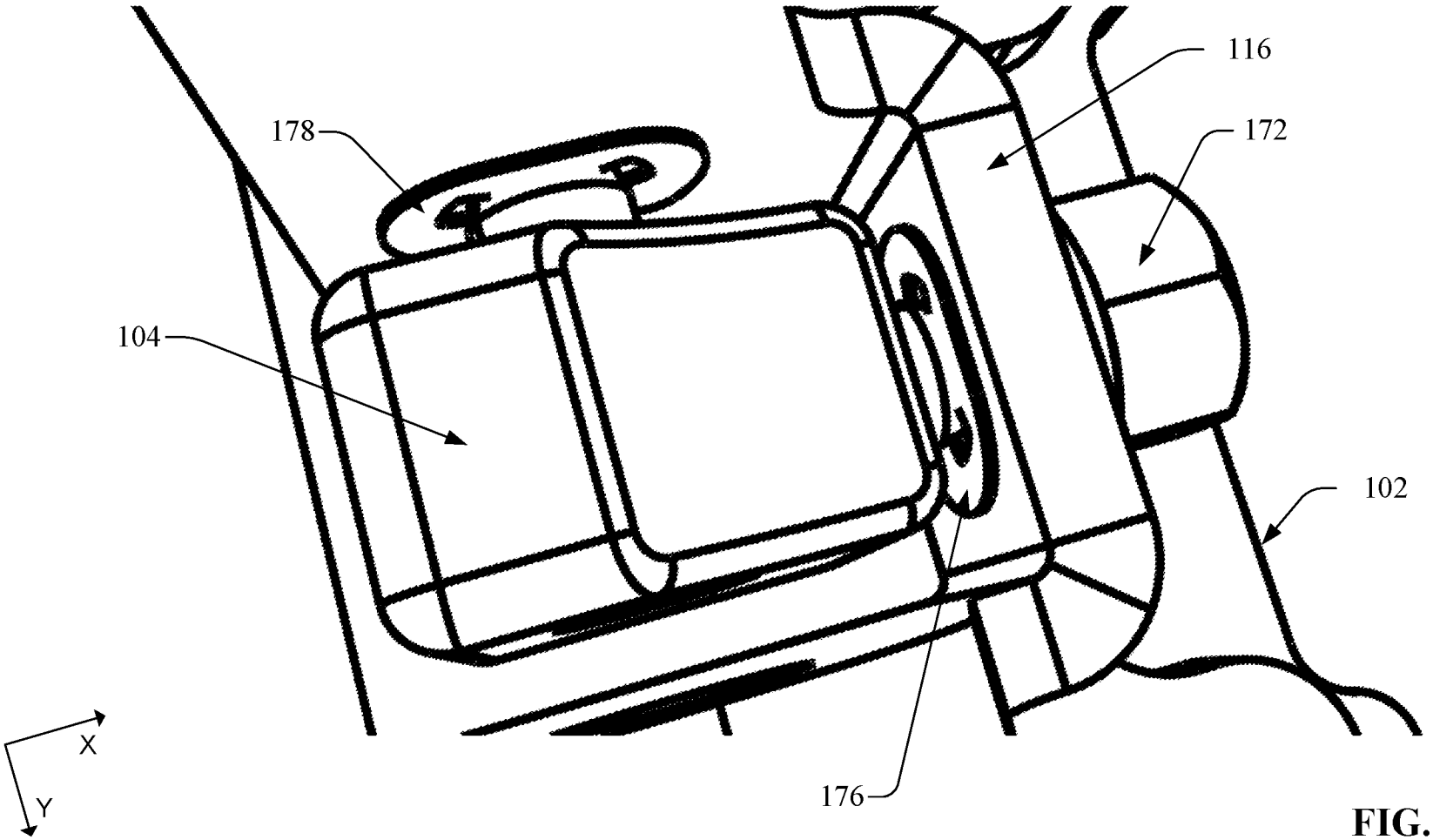
FIG. 25 shows exemplary hinge assembly component(s) in accordance with one or more embodiments described herein.

FIGS. 24 and 25 provide alternate close-up views of the hinge assembly 100. Components of the hinge assembly 100 can be made from metals and/or polymeric materials. For example, the hinge assembly 100 is made from steel and/or aluminum. Components of the hinge assembly 100 can be made using techniques known in the art, such as, but not limited to, forging, molding, machining, laser shaping, stereo lithography, sintering, additive manufacturing (e.g., 3D-printing), or combinations thereof.

Figure 26:
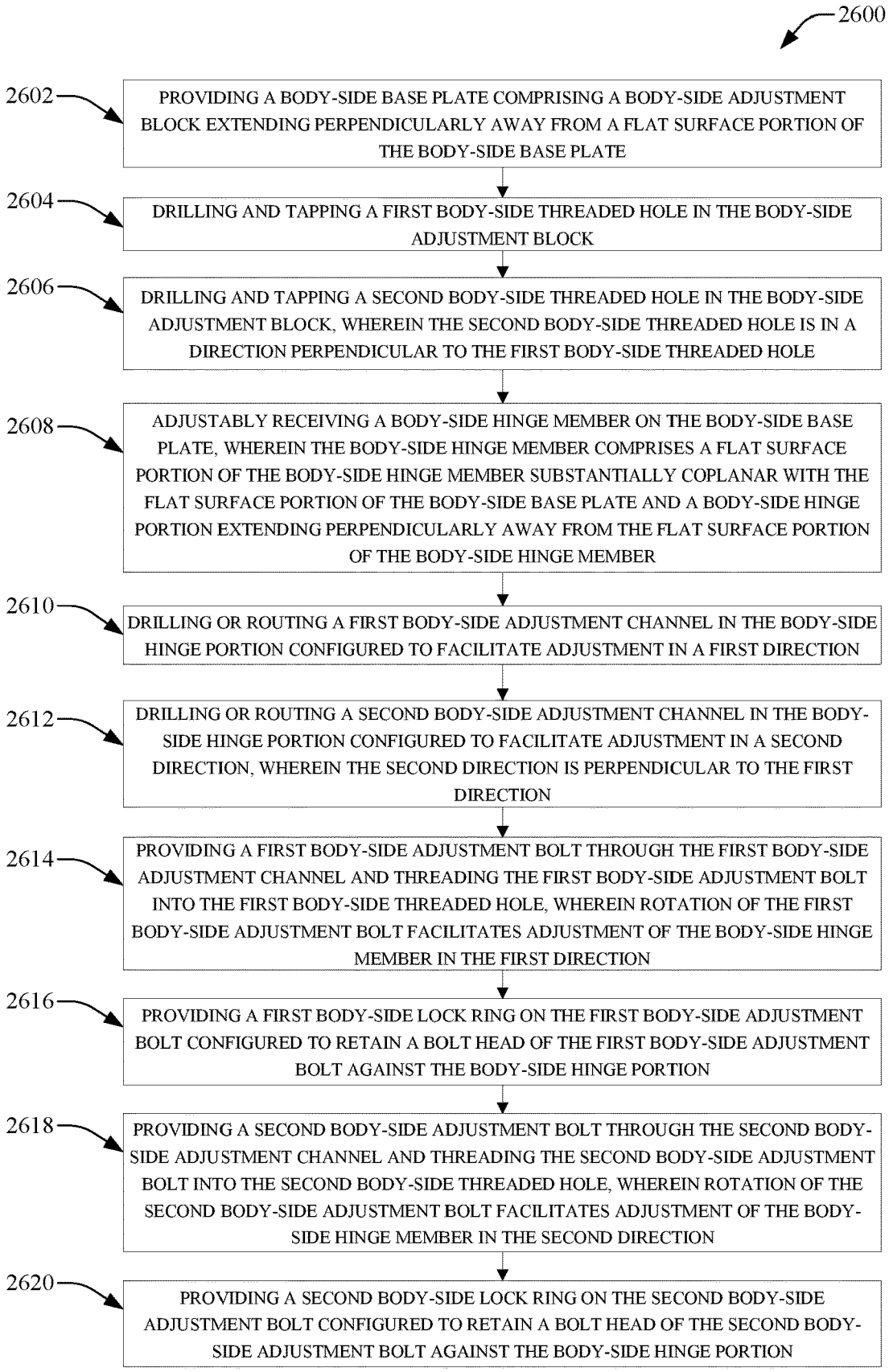
FIG. 26 is a block flow diagram for a process for a method for making a vehicle hinge in accordance with one or more embodiments described herein.

With reference to FIG. 26, a method for making a hinge assembly (e.g., hinge assembly 100 as described herein). At 2602, a body-side base plate (e.g., body-side base plate 102) comprising a body-side adjustment block (e.g., body-side adjustment block 104) extending perpendicularly away from a flat surface portion of the body-side base plate is provided. At 2604, a first body-side threaded hole (e.g., body-side threaded hole 106) is drilled and tapped in the body-side adjustment block. At 2606, a second body-side threaded hole (e.g., body-side threaded hole 108) is drilled and tapped in the body-side adjustment block, wherein the second body-side threaded hole is in a direction perpendicular to the first body-side threaded hole. At 2608, a body-side hinge member (e.g., body-side hinge member 114) is adjustably received on the body-side base plate, wherein the body-side hinge member comprises a flat surface portion of the body-side hinge member substantially coplanar with the flat surface portion of the body-side base plate and a body-side hinge portion extending perpendicularly away from the flat surface portion of the body-side hinge member. At 2610, a first body-side adjustment channel (e.g., body-side adjustment channel 118) is drilled or routed in the body-side hinge portion configured to facilitate adjustment in a first direction (e.g., the y-direction). At 2612, a second body-side adjustment channel (e.g., body-side adjustment channel 120) is drilled or routed in the body-side hinge portion configured to facilitate adjustment in a second direction (e.g., the x-direction), wherein the second direction is perpendicular to the first direction. At 2614, a first body-side adjustment bolt (e.g., body-side adjustment bolt 172) is provided through the first body-side adjustment channel and the first body-side adjustment bolt is threaded into the first body-side threaded hole, wherein rotation of the first body-side adjustment bolt facilitates adjustment of the body-side hinge member in the first direction. At 2616, first body-side lock ring is provided on the first body-side adjustment bolt configured to retain a bolt head of the first body-side adjustment bolt against the body-side hinge portion. At 2618, a second body-side adjustment bolt (e.g., body-side adjustment bolt 174) is provided through the second body-side adjustment channel and the second body-side adjustment bolt is threaded into the second body-side threaded hole, wherein rotation of the second body-side adjustment bolt facilitates adjustment of the body-side hinge member in the second direction. At 2620, a second body-side lock ring is provided on the second body-side adjustment bolt configured to retain a bolt head of the second body-side adjustment bolt against the body-side hinge portion FIG. 26, as described above illustrates respective methods or systems in accordance with certain aspects of this disclosure. While, for purposes of simplicity of explanation, the methods or systems are shown and described as a series of acts, it is to be understood and appreciated that this disclosure is not limited by the order of acts, as some acts may occur in different orders and/or concurrently with other acts from those shown and described herein. For example, those skilled in the art will understand and appreciate that methods can alternatively be represented as a series of interrelated states or events, such as in a state diagram. Moreover, not all illustrated acts may be required to implement methods in accordance with certain aspects of this disclosure.

The above description includes non-limiting examples of the various embodiments. It is, of course, not possible to describe every conceivable combination of components or methods for purposes of describing the disclosed subject matter, and one skilled in the art may recognize that further combinations and permutations of the various embodiments are possible. The disclosed subject matter is intended to embrace all such alterations, modifications, and variations that fall within the spirit and scope of the appended claims.

With regard to the various functions performed by the above-described components, devices, circuits, systems, etc., the terms (including a reference to a "means") used to describe such components are intended to also include, unless otherwise indicated, any structure(s) which performs the specified function of the described component (e.g., a functional equivalent), even if not structurally equivalent to the disclosed structure. In addition, while a particular feature of the disclosed subject matter may have been disclosed with respect to only one of several implementations, such feature may be combined with one or more other features of the other implementations as may be desired and advantageous for any given or particular application.

The terms "exemplary" and/or "demonstrative" as used herein are intended to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent structures and techniques known to one skilled in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

The term "or" as used herein is intended to mean an inclusive "or" rather than an exclusive "or." For example, the phrase "A or B" is intended to include instances of A, B, and both A and B. Additionally, the articles "a" and "an" as used in this application and the appended claims should generally be construed to mean "one or more" unless either otherwise specified or clear from the context to be directed to a singular form.

The term "set" as employed herein excludes the empty set, i.e., the set with no elements therein. Thus, a "set" in the subject disclosure includes one or more elements or entities. Likewise, the term "group" as utilized herein refers to a collection of one or more entities.

The description of illustrated embodiments of the subject disclosure as provided herein, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as one skilled in the art can recognize. In this regard, while the subject matter has been described herein in connection with various embodiments and corresponding drawings, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

Further aspects of the invention are provided by the subject matter of the following clauses:

1. A hinge assembly, comprising: a body-side base plate, wherein the body-side base plate comprises: a body-side adjustment block extending perpendicularly away from a flat surface portion of the body-side base plate, a first body-side threaded hole received in the body-side adjustment block, and a second body-side threaded hole received in the body-side adjustment block, wherein the second body-side threaded hole is in a direction perpendicular to the first body-side threaded hole; a body-side hinge member adjustably received on the body-side base plate, wherein the body-side hinge member comprises: a flat surface portion of the body-side hinge member substantially coplanar with the flat surface portion of the body-side base plate, a body-side hinge portion extending perpendicularly away from the flat surface portion of the body-side hinge member, a first body-side adjustment channel received in the body-side hinge portion configured to facilitate adjustment in a first direction, and a second body-side adjustment channel received in the body-side hinge portion configured to facilitate adjustment in a second direction, wherein the second direction is perpendicular to the first direction; a first body-side adjustment bolt received through the first body-side adjustment channel and threaded into the first body-side threaded hole, wherein rotation of the first body-side adjustment bolt facilitates adjustment of the body-side hinge member in the first direction; a first body-side lock ring received on the first body-side adjustment bolt configured to retain a bolt head of the first body-side adjustment bolt against the body-side hinge portion; a second body-side adjustment bolt received through the second body-side adjustment channel and threaded into the second body-side threaded hole, wherein rotation of the second body-side adjustment bolt facilitates adjustment of the body-side hinge member in the second direction; and a second body-side lock ring received on the second body-side adjustment bolt configured to retain a bolt head of the second body-side adjustment bolt against the body-side hinge portion.

2. The hinge assembly of any preceding clause further comprising: a tailgate-side base plate, wherein the tailgate-side base plate comprises: a tailgate-side adjustment block extending perpendicularly away from a flat surface portion of the tailgate-side base plate; a tailgate-side threaded hole received in the tailgate-side adjustment block; and a tailgate-side locking stud extending perpendicularly away from the flat surface portion of the tailgate-side base plate; a tailgate-side hinge member adjustably received on the tailgate-side base plate, wherein the tailgate-side hinge member comprises: a flat surface portion of the tailgate-side hinge member substantially coplanar with the flat surface portion of the tailgate-side base plate, a tailgate-side hinge portion extending outward from the flat surface portion of the tailgate-side hinge member, and a tailgate-side adjustment hole received in the tailgate-side hinge portion configured to facilitate adjustment in a third direction; a tailgate-side adjustment bolt received through the tailgate-side adjustment hole and threaded into the tailgate-side adjustment hole, wherein rotation of the tailgate-side adjustment bolt facilitates adjustment of the tailgate-side hinge member in the third direction; and a tailgate-side lock ring received on the tailgate-side adjustment bolt configured to retain a bolt head of the tailgate-side adjustment bolt against the tailgate-side hinge portion, wherein the tailgate-side hinge member is rotatably attached to the body-side hinge member with a shaft that passes through a pair of body-side hinge member coaxial holes of the body-side hinge member and a pair of tailgate-side hinge member coaxial holes of the tailgate-side hinge member.

3. The hinge assembly of any preceding clause wherein the flat surface portion of the tailgate-side hinge member comprises a hole comprising a diameter larger than a diameter of the tailgate-side locking stud, wherein the tailgate-side locking stud passes through the hole of the flat surface portion of the tailgate-side hinge member.

4. The hinge assembly of any preceding clause wherein: the body-side base plate comprises a first body-side locking stud extending perpendicularly away from the flat surface portion of the body-side base plate; and the flat surface portion of the body-side hinge member comprises an adjustment hole comprising a diameter larger than a diameter of the first body-side locking stud, wherein the first body-side locking stud passes through the adjustment hole of the flat surface portion of the body-side hinge member.

5. The hinge assembly of any preceding clause further comprising: a first body-side locking nut received on the first body-side locking stud, wherein the flat surface portion of the body-side hinge member is received between the first body-side locking nut and the flat surface portion of the body-side base plate, and wherein tightening of the first body-side locking nut immovably pinches the body-side hinge member against the body-side base plate.

6. The hinge assembly of any preceding clause wherein the adjustment hole of the flat surface portion of the body-side hinge member is a first adjustment hole, and wherein: the body-side base plate comprises a second body-side locking stud extending perpendicularly away from the flat surface portion of the body-side base plate; the flat surface portion of the body-side hinge member comprises a second adjustment hole comprising a diameter larger than a diameter of the second body-side locking stud, wherein the second body-side locking stud passes through the second adjustment hole of the flat surface portion of the body-side hinge member; and a second body-side locking nut is received on the second body-side locking stud, wherein the flat surface portion of the body-side hinge member is received between the second body-side locking nut and the flat surface portion of the body-side base plate, and wherein tightening of the second body-side locking nut immovably pinches the body-side hinge member against the body-side base plate.

7. The hinge assembly of any preceding clause wherein the first direction is a y-direction, and the second direction is an x-direction, and the x and y directions are in a plane parallel to the flat surface portion of the body-side base plate.

8. The hinge assembly of any preceding clause further comprising: a first body-side mounting stud extending perpendicularly away from a second flat surface portion of the body-side base plate; and a second body-side mounting stud extending perpendicularly away from the second flat surface portion of the body-side base plate, wherein the second flat surface portion is on a side opposite the flat surface portion of the body-side base plate.

9. The hinge assembly of any preceding clause wherein the first body-side mounting stud and the second body-side mounting stud define holes configured for mounting the body-side base plate to an automobile body.

10. The hinge assembly of clause 1 above with any set of combinations of the hinge assemblies of clauses 2-9 above.

11. A method for making a hinge assembly, comprising: providing a body-side base plate comprising a body-side adjustment block extending perpendicularly away from a flat surface portion of the body-side base plate; drilling and tapping a first body-side threaded hole in the body-side adjustment block; drilling and tapping a second body-side threaded hole in the body-side adjustment block, wherein the second body-side threaded hole is in a direction perpendicular to the first body-side threaded hole; adjustably receiving a body-side hinge member on the body-side base plate, wherein the body-side hinge member comprises a flat surface portion of the body-side hinge member substantially coplanar with the flat surface portion of the body-side base plate and a body-side hinge portion extending perpendicularly away from the flat surface portion of the body-side hinge member; drilling or routing a first body-side adjustment channel in the body-side hinge portion configured to facilitate adjustment in a first direction; drilling or routing a second body-side adjustment channel in the body-side hinge portion configured to facilitate adjustment in a second direction, wherein the second direction is perpendicular to the first direction; providing a first body-side adjustment bolt through the first body-side adjustment channel and threading the first body-side adjustment bolt into the first body-side threaded hole, wherein rotation of the first body-side adjustment bolt facilitates adjustment of the body-side hinge member in the first direction; providing a first body-side lock ring on the first body-side adjustment bolt configured to retain a bolt head of the first body-side adjustment bolt against the body-side hinge portion; providing a second body-side adjustment bolt through the second body-side adjustment channel and threading the second body-side adjustment bolt into the second body-side threaded hole, wherein rotation of the second body-side adjustment bolt facilitates adjustment of the body-side hinge member in the second direction; and providing a second body-side lock ring on the second body-side adjustment bolt configured to retain a bolt head of the second body-side adjustment bolt against the body-side hinge portion.

12. The method of any preceding clause further comprising: providing a tailgate-side base plate comprising a tailgate-side adjustment block extending perpendicularly away from a flat surface portion of the tailgate-side base plate; drilling and tapping a tailgate-side threaded hole in the tailgate-side adjustment block; adjustably receiving a tailgate-side hinge member on the tailgate-side base plate, wherein the tailgate-side hinge member comprises a flat surface portion of the tailgate-side hinge member substantially coplanar with the flat surface portion of the tailgate-side base plate and a tailgate-side hinge portion extending outward from the flat surface portion of the tailgate-side hinge member; drilling or routing a tailgate-side adjustment hole in the tailgate-side hinge portion configured to facilitate adjustment in a third direction; providing a tailgate-side adjustment bolt through the tailgate-side adjustment hole and threading the tailgate-side adjustment bolt into the tailgate-side threaded hole, wherein rotation of the tailgate-side adjustment bolt facilitates adjustment of the tailgate-side hinge member in the third direction; providing a tailgate-side lock ring on the tailgate-side adjustment bolt configured to retain a bolt head of the tailgate-side adjustment bolt against the tailgate-side hinge portion; and hingedly mounting a tailgate-side hinge member to the body-side hinge member using a shaft received through a pair of body-side hinge member coaxial holes of the body-side hinge member and a pair of tailgate-side hinge member coaxial holes of the tailgate-side hinge member.

13. The method of any preceding clause further comprising: providing a pair of bushings on the shaft, wherein a first bushing of the pair of bushings is received between the shaft and a first tailgate-side hinge member coaxial hole of the pair of tailgate-side hinge member coaxial holes and a second bushing of the pair of bushings is received between the shaft and a second tailgate-side hinge member coaxial hole of the pair of tailgate-side hinge member coaxial holes.

14. The method of any preceding clause wherein the shaft is press-fit into a first body-side coaxial hole of the pair of body-side hinge member coaxial holes.

15. The method of any preceding clause wherein the shaft is press-fit into a second body-side coaxial hole of the pair of body-side hinge member coaxial holes.

16. The method of any preceding clause wherein the body-side base plate comprises a body-side locking stud extending perpendicularly away from the flat surface portion of the body-side base plate; and the flat surface portion of the body-side hinge member comprises a hole comprising a diameter larger than a diameter of the body-side locking stud, wherein the body-side locking stud passes through the hole of the flat surface portion of the body-side hinge member.

17. The method of any preceding clause further comprising: providing a body-side locking nut on the body-side locking stud, wherein the flat surface portion of the body-side hinge member is received between the body-side locking nut and the flat surface portion of the body-side base plate, and wherein tightening of the body-side locking nut immovably pinches the body-side hinge member against the body-side base plate.

18. The method of clause 11 above with any set of combinations of the methods of clauses 12-17 above.

19. A vehicle tailgate hinge assembly, comprising: a body-side base plate adapted to be mounted to an automobile body with a pair of body-mounting studs extending perpendicularly away from a bottom surface of the body-side base plate, wherein the body-side base plate comprises: a body-side adjustment block extending perpendicularly away from a top surface of the body-side base plate, a first body-side threaded hole received in the body-side adjustment block, and a second body-side threaded hole received in the body-side adjustment block, wherein the second body-side threaded hole is in a direction perpendicular to the first body-side threaded hole; a body-side hinge member adjustably received on the body-side base plate, wherein the body-side hinge member comprises: a bottom surface of the body-side hinge member substantially coplanar with the top surface of the body-side base plate, a body-side hinge portion extending perpendicularly away from the top surface of the body-side hinge member, a first body-side adjustment channel received in the body-side hinge portion configured to facilitate adjustment in a first direction, and a second body-side adjustment channel received in the body-side hinge portion configured to facilitate adjustment in a second direction, wherein the second direction is perpendicular to the first direction; a first body-side adjustment bolt received through the first body-side adjustment channel and threaded into the first body-side threaded hole, wherein rotation of the first body-side adjustment bolt facilitates adjustment of the body-side hinge member in the first direction; a first body-side lock ring received on the first body-side adjustment bolt configured to retain a bolt head of the first body-side adjustment bolt against the body-side hinge portion; a second body-side adjustment bolt received through the second body-side adjustment channel and threaded into the second body-side threaded hole, wherein rotation of the second body-side adjustment bolt facilitates adjustment of the body-side hinge member in the second direction; a second body-side lock ring received on the second body-side adjustment bolt configured to retain a bolt head of the second body-side adjustment bolt against the body-side hinge portion; a pair of body-side coaxial holes at a distal end of the body-side hinge member configured to receive a shaft; a tailgate-side base plate, wherein the tailgate-side base plate comprises: a tailgate-side adjustment block extending perpendicularly away from a flat surface portion of the tailgate-side base plate; a tailgate-side threaded hole received in the tailgate-side adjustment block; and a tailgate-side locking stud extending perpendicularly away from the flat surface portion of the tailgate-side base plate; a tailgate-side hinge member adjustably received on the tailgate-side base plate, wherein the tailgate-side hinge member comprises: a flat surface portion of the tailgate-side hinge member substantially coplanar with the flat surface portion of the tailgate-side base plate, a tailgate-side hinge portion extending outward from the flat surface portion of the tailgate-side hinge member, and a tailgate-side adjustment hole received in the tailgate-side hinge portion configured to facilitate adjustment in a third direction; a tailgate-side adjustment bolt received through the tailgate-side adjustment hole and threaded into the tailgate-side adjustment hole, wherein rotation of the tailgate-side adjustment bolt facilitates adjustment of the tailgate-side hinge member in the third direction; and a tailgate-side lock ring received on the tailgate-side adjustment bolt configured to retain a bolt head of the tailgate-side adjustment bolt against the tailgate-side hinge portion, wherein the tailgate-side hinge member is rotatably attached to the body-side hinge member with a shaft that passes through a pair of body-side hinge member coaxial holes of the body-side hinge member and a pair of tailgate-side hinge member coaxial holes of the tailgate-side hinge member.

20. The vehicle tailgate hinge assembly of any preceding clause further comprising: a body-side locking stud extending perpendicularly away from the top surface of the body-side base plate; a body-side washer received on the body-side locking stud, wherein the flat surface portion of the body-side hinge member is received between the body-side washer and the top surface of the body-side base plate; a body-side locking nut received on the body-side locking stud, wherein the body-side washer is received between the body-side locking nut and the top surface of the body-side hinge member, wherein tightening of the body-side locking nut immovably pinches the body-side hinge member against the body-side base plate.

21. The vehicle tailgate hinge assembly of any preceding clause further comprising: a locking stud extending perpendicularly away from the top surface of the tailgate-side base plate; a tailgate-side washer received on the tailgate-side locking stud, wherein the flat surface portion of the tailgate-side hinge member is received between the tailgate-side washer and the top surface of the tailgate-side base plate; a tailgate-side locking nut received on the tailgate-side locking stud, wherein the tailgate-side washer is received between the tailgate-side locking nut and the top surface of the tailgate-side hinge member, wherein tightening of the tailgate-side locking nut immovably pinches the tailgate-side hinge member against the tailgate-side base plate.

22. The vehicle tailgate hinge assembly of any preceding clause wherein the first direction is a y direction, and the second direction is an x direction, the third direction is a z direction, the x and y directions are in a plane parallel to the flat surface portion of the body-side base plate.

23. The vehicle tailgate hinge assembly of clause 19 above with any set of combinations of the vehicle tailgate hinge assemblies of clauses 20-22 above.

What is claimed is:

1. A hinge assembly, comprising:

a body-side base plate, wherein the body-side base plate comprises:

a body-side adjustment block extending perpendicularly away from a flat surface portion of the body-side base plate, a first body-side threaded hole received in the body-side adjustment block, and a second body-side threaded hole received in the body-side adjustment block, wherein the second body-side threaded hole is in a direction perpendicular to the first body-side threaded hole;

a body-side hinge member adjustably received on the body-side base plate, wherein the body-side hinge member comprises:

a flat surface portion of the body-side hinge member substantially coplanar with the flat surface portion of the body-side base plate, a body-side hinge portion extending perpendicularly away from the flat surface portion of the body-side hinge member, a first body-side adjustment channel received in the body-side hinge portion configured to facilitate adjustment in a first direction, and a second body-side adjustment channel received in the body-side hinge portion configured to facilitate adjustment in a second direction, wherein the second direction is perpendicular to the first direction;

a first body-side adjustment bolt received through the first body-side adjustment channel and threaded into the first body-side threaded hole, wherein rotation of the first body-side adjustment bolt facilitates adjustment of the body-side hinge member in the first direction;

a first body-side lock ring received on the first body-side adjustment bolt configured to retain a bolt head of the first body-side adjustment bolt against the body-side hinge portion;

a second body-side adjustment bolt received through the second body-side adjustment channel and threaded into the second body-side threaded hole, wherein rotation of the second body-side adjustment bolt facilitates adjustment of the body-side hinge member in the second direction; and a second body-side lock ring received on the second body-side adjustment bolt configured to retain a bolt head of the second body-side adjustment bolt against the body-side hinge portion.

2. The hinge assembly of claim 1, further comprising:

a tailgate-side base plate, wherein the tailgate-side base plate comprises:

a tailgate-side adjustment block extending perpendicularly away from a flat surface portion of the tailgate-side base plate;

a tailgate-side threaded hole received in the tailgate-side adjustment block; and a tailgate-side locking stud extending perpendicularly away from the flat surface portion of the tailgate-side base plate;

a tailgate-side hinge member adjustably received on the tailgate-side base plate, wherein the tailgate-side hinge member comprises:

a flat surface portion of the tailgate-side hinge member substantially coplanar with the flat surface portion of the tailgate-side base plate, a tailgate-side hinge portion extending outward from the flat surface portion of the tailgate-side hinge member, and a tailgate-side adjustment hole received in the tailgate-side hinge portion configured to facilitate adjustment in a third direction;

a tailgate-side adjustment bolt received through the tailgate-side adjustment hole and threaded into the tailgate-side adjustment hole, wherein rotation of the tailgate-side adjustment bolt facilitates adjustment of the tailgate-side hinge member in the third direction; and a tailgate-side lock ring received on the tailgate-side adjustment bolt configured to retain a bolt head of the tailgate-side adjustment bolt against the tailgate-side hinge portion, wherein the tailgate-side hinge member is rotatably attached to the body-side hinge member with a shaft that passes through a pair of body-side hinge member coaxial holes of the body-side hinge member and a pair of tailgate-side hinge member coaxial holes of the tailgate-side hinge member.

3. The hinge assembly of claim 2, wherein the flat surface portion of the tailgate-side hinge member comprises a hole comprising a diameter larger than a diameter of the tailgate-side locking stud, wherein the tailgate-side locking stud passes through the hole of the flat surface portion of the tailgate-side hinge member.

4. The hinge assembly of claim 1, wherein:

the body-side base plate comprises a first body-side locking stud extending perpendicularly away from the flat surface portion of the body-side base plate; and the flat surface portion of the body-side hinge member comprises an adjustment hole comprising a diameter larger than a diameter of the first body-side locking stud, wherein the first body-side locking stud passes through the adjustment hole of the flat surface portion of the body-side hinge member.

5. The hinge assembly of claim 4, further comprising:

a first body-side locking nut received on the first body-side locking stud, wherein the flat surface portion of the body-side hinge member is received between the first body-side locking nut and the flat surface portion of the body-side base plate, and wherein tightening of the first body-side locking nut immovably pinches the body-side hinge member against the body-side base plate.

6. The hinge assembly of claim 5, wherein, the adjustment hole of the flat surface portion of the body-side hinge member is a first adjustment hole, and wherein:

the body-side base plate comprises a second body-side locking stud extending perpendicularly away from the flat surface portion of the body-side base plate;

the flat surface portion of the body-side hinge member comprises a second adjustment hole comprising a diameter larger than a diameter of the second body-side locking stud, wherein the second body-side locking stud passes through the second adjustment hole of the flat surface portion of the body-side hinge member; and a second body-side locking nut is received on the second body-side locking stud, wherein the flat surface portion of the body-side hinge member is received between the second body-side locking nut and the flat surface portion of the body-side base plate, and wherein tightening of the second body-side locking nut immovably pinches the body-side hinge member against the body-side base plate.

7. The hinge assembly of claim 1, wherein the first direction is a y-direction, and the second direction is an x-direction, and the x and y directions are in a plane parallel to the flat surface portion of the body-side base plate.

8. The hinge assembly of claim 1, further comprising:

a first body-side mounting stud extending perpendicularly away from a second flat surface portion of the body-side base plate; and a second body-side mounting stud extending perpendicularly away from the second flat surface portion of the body-side base plate, wherein the second flat surface portion is on a side opposite the flat surface portion of the body-side base plate.

9. The hinge assembly of claim 8, wherein the first body-side mounting stud and the second body-side mounting stud define holes configured for mounting the body-side base plate to an automobile body.

10. A vehicle tailgate hinge assembly, comprising:

a body-side base plate adapted to be mounted to an automobile body with a pair of body-mounting studs extending perpendicularly away from a bottom surface of the body-side base plate, wherein the body-side base plate comprises:

a body-side adjustment block extending perpendicularly away from a top surface of the body-side base plate, a first body-side threaded hole received in the body-side adjustment block, and a second body-side threaded hole received in the body-side adjustment block, wherein the second body-side threaded hole is in a direction perpendicular to the first body-side threaded hole;

a body-side hinge member adjustably received on the body-side base plate, wherein the body-side hinge member comprises:

a bottom surface of the body-side hinge member substantially coplanar with the top surface of the body-side base plate, a body-side hinge portion extending perpendicularly away from the top surface of the body-side hinge member, a first body-side adjustment channel received in the body-side hinge portion configured to facilitate adjustment in a first direction, and a second body-side adjustment channel received in the body-side hinge portion configured to facilitate adjustment in a second direction, wherein the second direction is perpendicular to the first direction;

a first body-side adjustment bolt received through the first body-side adjustment channel and threaded into the first body-side threaded hole, wherein rotation of the first body-side adjustment bolt facilitates adjustment of the body-side hinge member in the first direction;

a first body-side lock ring received on the first body-side adjustment bolt configured to retain a bolt head of the first body-side adjustment bolt against the body-side hinge portion;

a second body-side adjustment bolt received through the second body-side adjustment channel and threaded into the second body-side threaded hole, wherein rotation of the second body-side adjustment bolt facilitates adjustment of the body-side hinge member in the second direction;

a second body-side lock ring received on the second body-side adjustment bolt configured to retain a bolt head of the second body-side adjustment bolt against the body-side hinge portion;

a pair of body-side coaxial holes at a distal end of the body-side hinge member configured to receive a shaft;

a tailgate-side base plate, wherein the tailgate-side base plate comprises:

a tailgate-side adjustment block extending perpendicularly away from a flat surface portion of the tailgate-side base plate;

a tailgate-side threaded hole received in the tailgate-side adjustment block; and a tailgate-side locking stud extending perpendicularly away from the flat surface portion of the tailgate-side base plate;

a tailgate-side hinge member adjustably received on the tailgate-side base plate, wherein the tailgate-side hinge member comprises:

a flat surface portion of the tailgate-side hinge member substantially coplanar with the flat surface portion of the tailgate-side base plate, a tailgate-side hinge portion extending outward from the flat surface portion of the tailgate-side hinge member, and a tailgate-side adjustment hole received in the tailgate-side hinge portion configured to facilitate adjustment in a third direction;

a tailgate-side adjustment bolt received through the tailgate-side adjustment hole and threaded into the tailgate-side threaded hole, wherein rotation of the tailgate-side adjustment bolt facilitates adjustment of the tailgate-side hinge member in the third direction; and a tailgate-side lock ring received on the tailgate-side adjustment bolt configured to retain a bolt head of the tailgate-side adjustment bolt against the tailgate-side hinge portion, wherein the tailgate-side hinge member is rotatably attached to the body-side hinge member with a shaft that passes through said pair of body-side hinge member coaxial holes of the body-side hinge member and a pair of tailgate-side hinge member coaxial holes of the tailgate-side hinge member.

11. The vehicle tailgate hinge assembly of claim 10, further comprising:

a body-side locking stud extending perpendicularly away from the top surface of the body-side base plate;

a body-side washer received on the body-side locking stud, wherein the flat surface portion of the body-side hinge member is received between the body-side washer and the top surface of the body-side base plate;

a body-side locking nut received on the body-side locking stud, wherein the body-side washer is received between the body-side locking nut and the top surface of the body-side hinge member, wherein tightening of the body-side locking nut immovably pinches the body-side hinge member against the body-side base plate.

12. The vehicle tailgate hinge assembly of claim 10, further comprising:

a tailgate-side washer received on the tailgate-side locking stud, wherein the flat surface portion of the tailgate-side hinge member is received between the tailgate-side washer and the top surface of the tailgate-side base plate;

a tailgate-side locking nut received on the tailgate-side locking stud, wherein the tailgate-side washer is received between the tailgate-side locking nut and the top surface of the tailgate-side hinge member, wherein tightening of the tailgate-side locking nut immovably pinches the tailgate-side hinge member against the tailgate-side base plate.

13. The vehicle tailgate hinge assembly of claim 10, wherein the first direction is a y direction, and the second direction is an x direction, the third direction is a z direction, the x and y directions are in a plane parallel to the flat surface portion of the body-side base plate.

* * * * *